US010850888B2

(12) United States Patent
Ramsey et al.

(10) Patent No.: US 10,850,888 B2
(45) Date of Patent: Dec. 1, 2020

(54) CONCAVE CAN END

(71) Applicant: CROWN Packaging Technology, Inc., Alsip, IL (US)

(72) Inventors: Christopher Paul Ramsey, Wantage (GB); Ben Mattin, Wantage (GB); Tim Clark, Wantage (GB)

(73) Assignee: Crown Packaging Technology, Inc., Alsip, IL (US)

( * ) Notice: Subject to any disclaimer, the term of this patent is extended or adjusted under 35 U.S.C. 154(b) by 684 days.

(21) Appl. No.: 15/445,709

(22) Filed: Feb. 28, 2017

(65) Prior Publication Data

US 2017/0253371 A1 Sep. 7, 2017

Related U.S. Application Data

(60) Provisional application No. 62/301,128, filed on Feb. 29, 2016.

(51) Int. Cl.

| | |
|---|---|
| ***B65D 17/32*** | (2006.01) |
| ***B65D 17/28*** | (2006.01) |
| ***B65D 17/00*** | (2006.01) |
| ***B21D 22/22*** | (2006.01) |
| ***B65D 6/30*** | (2006.01) |
| ***B21D 51/44*** | (2006.01) |
| ***B21D 51/26*** | (2006.01) |
| ***B21D 51/32*** | (2006.01) |
| ***B21D 51/38*** | (2006.01) |
| ***B65D 1/16*** | (2006.01) |
| ***B65D 1/20*** | (2006.01) |

(52) U.S. Cl.

CPC ..... *B65D 17/02* (2013.01); *B21D 22/22* (2013.01); *B21D 51/2623* (2013.01); *B21D 51/2661* (2013.01); *B21D 51/32* (2013.01); *B21D 51/383* (2013.01); *B21D 51/44* (2013.01); *B65D 1/165* (2013.01); *B65D 1/20* (2013.01); *B65D 7/36* (2013.01); *B65D 17/4012* (2018.01); *B65D 2517/0014* (2013.01)

(58) Field of Classification Search

CPC .... B65D 17/02; B65D 17/4012; B65D 1/165; B65D 1/20; B65D 7/36; B21D 22/22

USPC ..... 220/268, 270

See application file for complete search history.

(56) References Cited

U.S. PATENT DOCUMENTS

| | | | | |
|---|---|---|---|---|
| 2,971,671 A | | 2/1961 | Shakman | |
| 3,394,837 A | * | 7/1968 | Hansen | B65D 17/4012 220/270 |
| 3,448,887 A | * | 6/1969 | Geiger | B65D 17/4012 220/273 |
| 3,730,383 A | | 5/1973 | Dunn et al. | |
| 4,458,469 A | * | 7/1984 | Dunn | B65D 15/06 220/624 |

(Continued)

FOREIGN PATENT DOCUMENTS

| | | |
|---|---|---|
| EP | 2322440 A1 | 5/2011 |
| RU | 2156215 C1 | 9/2000 |

(Continued)

*Primary Examiner* — J. Gregory Pickett
*Assistant Examiner* — Niki M Eloshway
(74) *Attorney, Agent, or Firm* — BakerHostetler

(57) ABSTRACT

A container can end includes a concave dome shape and may forgo a peripheral reinforcing bead around the center panel. The tab may also be curved. Tooling for forming the end and a corresponding method are provided.

72 Claims, 21 Drawing Sheets

(56) References Cited

U.S. PATENT DOCUMENTS

| | | | | |
|---|---|---|---|---|
| 4,516,420 | A | 5/1985 | Bulso, Jr. et al. | |
| 4,549,424 | A | 10/1985 | Bulso, Jr. et al. | |
| 4,680,917 | A * | 7/1987 | Hambleton | B65D 17/502 53/440 |
| 4,998,638 | A * | 3/1991 | Kawamata | B65D 79/005 215/270 |
| 5,149,238 | A | 9/1992 | McEldowney et al. | |
| 5,344,662 | A * | 9/1994 | Payne | B65D 51/1677 220/374 |
| 5,535,911 | A * | 7/1996 | Cortez | B65D 17/401 220/268 |
| 5,804,237 | A | 9/1998 | Diamond et al. | |
| 6,126,034 | A | 10/2000 | Borden et al. | |
| 6,561,004 | B1 | 5/2003 | Neiner et al. | |
| 7,644,833 | B2 | 1/2010 | Turner et al. | |
| 8,191,726 | B2 * | 6/2012 | Heinicke | B65D 17/4012 220/619 |
| 2002/0014489 | A1 * | 2/2002 | Anthony | B65D 17/4012 220/271 |
| 2002/0158071 | A1 | 10/2002 | Chasteen et al. | |
| 2004/0241789 | A1 | 12/2004 | Chasteen et al. | |
| 2014/0008367 | A1 * | 1/2014 | Jung | B65D 7/04 220/270 |
| 2016/0031594 | A1 * | 2/2016 | Ramsey | B65D 17/02 220/272 |

FOREIGN PATENT DOCUMENTS

| | | | |
|---|---|---|---|
| WO | WO 97/00743 | A1 | 1/1997 |
| WO | WO 2013/057250 | A1 | 4/2013 |

* cited by examiner

CONCAVE CAN END

This claims the benefit of U.S. Provisional Application Ser. No. 62/301,128 filed Feb. 29, 2016, the disclosure of which is hereby incorporated by reference as if set forth in its entirety herein.

BACKGROUND

Commercial cans, such as those for holding food, beverages, or products dispensed as an aerosol, can be a "two-piece" or "three-piece" configuration. A conventional two piece can includes a single-piece can body that is formed by a drawing and ironing process also known as drawn and wall ironing ("DWI"). A DWI process draws a metal blank into a cup shape, then the cup is pushed through a series of rings which iron the wall to its desired thickness and length. At the end of the ironing process, the can is pushed into a doming station to form the bottom dome of the integral can body. The open can end is then trimmed, necked down in diameter, deformed outwardly to form a flange.

The second part of a two piece can is the end or lid. Beverage can ends are formed by forming the shell from a flat sheet in a shell press. Then the shell has a tab attached by a rivet in a conversion press.

Modern, lightweight beverage can ends include a curl at its periphery, a wall that extends radially inwardly and downwardly relative to the curl, a reinforcement structure (such as an upwardly opening groove), and a flat or nearly flat center panel. A score in the center panel is configured to open by actuation of the tab.

Beverage can ends for beer often have the requirement of withstanding 90 psi (6.2 bar) internal pressure to survive the pasteurizing process. Beverage cans for carbonated soft drinks often must meet similar standards. The reinforcement structure (that is, the reinforcing groove) between the can end wall and the circular center panel stiffens the structure against the force of internal pressure, and it is at this location that pressurized can ends sometimes fail.

Thus, all commercially successful can ends for carbonated beverages, such as older B64 ends, lightweight ends marketed by Crown Cork & Seal Co., referred to generally as SuperEnd® ends, and those marketed by Ball Corp., referred to generally as CDL™ ends, have an open upwardly opening groove. Alternative reinforcing structures have been proposed, such as a collapsed or restricted structure of an "outwardly extending reinforcing bead" disclosed in Patent Application US2002/0158071 (Chasteen), a "fold having a portion located radially outwardly of the chuck wall" disclosed in U.S. Pat. No. 7,644,833 (Turner), or a "bead which is connected between a radially outer edge of the panel wall and a radially inner edge of the chuck wall structure . . . and extends at least partially radially outwardly" disclosed in WO2013057250 (Dunwoody). But it is conventional for modern beverage can ends to have a reinforcing structure of some type at the periphery of the center panel. For a specific example, the countersink groove of a B64 end includes a relatively steeply inclined outer wall and a relatively upright inboard wall that merges into the center panel. The B64 end has a depth from the top of the panel to the top of the curl of approximately 4 mm. Prior art shell presses for forming conventional beverage can ends are, for example, disclosed in U.S. Pat. Nos. 4,516,420 and 4,549,424 ("Bulso").

The most common beverage can body (nominal diameter) size is a 211 (2 and $^{11}/_{16}{}^{th}$ inches, as the conventional nomenclature in the U.S. is to use the first digit for inches and the second two digits for the number of sixteenths of an inch) or 66 mm diameter. End sizes are typically are 202, 204, or 206 inches, which reflect the most common necking magnitude. Other beverage can nominal diameters are 58 mm and 53.5 mm, which are generally referred to as "Sleek" cans and "Slim Cans," respectively.

Conventional beverage can end center panels are flat or nearly flat, especially in their unpressurized state, as it is understood that some deformation occurs when the end is under pressure. The term flat encompasses a panel that has recesses, raised beads, and like surface features. The term "nearly flat" also encompasses tolerances and some minor deformation in the shell press and conversion press.

To attach the end to the can, the end curl is placed on the flange of the can body, and then seaming chucks deform the curl and flange to form a conventional double seam. The commercial seaming process for metal containers requires great precision to make reliable containers by the billions without metal wrinkling. Further, insufficient seaming dimensions, such as overlap between the terminal parts of the can flange and the end curl, and like parameters, that can cause failure under pressure. Thus, metal seams have a seaming length, for example, of 2.55 mm (+/−0.15 mm) for a conventional B64 end and 2.50 mm (+/−0.15 mm) for a lightweight end marketed by Crown Cork & Seal, Inc. as its ISE end, and a seam thickness of more than 1.0 mm, and a seaming radius of more than 0.5 mm. Seam thickness is usually calculated or approximated as three times the end thickness plus two times the flange thickness plus a freespace, which is sometimes approximated to be 0.13 mm. Further, the end thickness is greater than the can body flange thickness in the seam in all commercial beverage cans of which the inventors are aware because of end pressure rating requirements.

Three piece cans, which are often employed for holding food, include a cylindrical body with ends seamed onto each end. Conventional food ends typically do not have the same internal pressure rating as carbonated beverage cans. Accordingly, conventional food can ends typically are flat and do not have the strengthening groove.

In a three piece can, a cylindrical body is formed, often by rolling a rectangular sheet and welding a seam. An end is seamed onto each end of the cylindrical body.

Aerosol containers often are three piece cans and include a domed bottom end that is seamed onto the bottom of a cylindrical can body. Aerosol can ends are significantly thicker than ends of beverage cans. Further, aerosol can ends are formed of steel or a relatively ductile aluminium alloy (compared with 5000 series aluminium alloy typical for beverage can ends). Thus, aerosol can ends are usually formed by a press having a domed die center block against which the material is formed, usually by coining, without which the end product has a commercially unacceptable magnitude of wrinkling.

SUMMARY

A can end includes a center panel that is concave (that is, viewed from above). The description is directed specifically to a beverage can end of the type capable of use with beer or carbonated soft drink, with specific advantages. The end structure may also be used for food can ends, beverage cans that require a lower pressure rating than is common for carbonated beverages (such as 90 psi), and for products dispensed from aerosols.

The embodiment having a dome panel without a countersink has the advantages of reduced weight of the shell, which in turn enables a more compact seam that also provides weight savings while forming a commercially acceptable seam. Moreover, necking the can body to accommodate the end, as well as the end structure itself, produces an advantageous headspace clearance (that is, the distance between the underside of the end or the pour opening and the liquid surface). The end structure provides improved cleanliness as there is no groove to trap debris during transit (for example) and liquid from the can drain away from the periphery and possibly back into the open can rather than becoming trapped in the groove. And as the pour opening can be located closer to the seam (because there is no groove between the pour opening and the seam), the drinking experience can be more like drinking from a glass compared with conventional cans.

In this regard, an unseamed can end capable of withstanding 90 psi internal pressure after seaming onto a can body is formed of an aluminum alloy, preferably a 5000 series alloy (although other allows, such as a 3000 series aluminum alloy) is contemplated. The unseamed can end includes: (i) a curl structure adapted for being seamed together with a flange of a can body; (ii) a chuck wall extending radially inwardly from the curl structure, the chuck wall is adapted for contact with a chuck during the seaming process; (iii) an inwardly domed panel radially inwardly from the chuck wall; (iv) a score formed on the panel; and a tab (preferably curved at approximately the same shape as the panel) or other opening feature attached to the panel and adapted for rupturing the score in response to actuation of the tab by a user to form a pour opening. The other opening features can include a press button, a peelable foil, and the like. The panel extends from a lower end of the chuck wall into the panel with no countersink bead therebetween. The can end preferably is a beverage can end, but the structure may also be employed for a food can end or an aerosol product end.

Preferably, the diameter of the can end is less than 10 times a height of the dome at a center of the end, and more preferably between 4 and 8 times a height of the dome at a center of the end. The end formed as described herein can be made lightweight, such as of a 5000 series alloy that is less than 0.20 mm thick, more preferably less than 0.18 mm thick, an in preferred embodiments less than 0.16 mm thick.

The curl of the end is configured such that the unseamed end has a stacking height S of between 1.7 and 3.0 mm, and preferably at least 1.8 mm. The curl is configured to have a width of less than 3.5 mm, more preferably less than 3.0. mm, measured radially and horizontally between the outboard most point of the curl structure and the point on the curl at which a seaming panel of the curl structure yields to a relatively straight portion of a chuck wall of the end.

The panel is a dome-shaped such that the slope of the tangent of a curve defined by the end at every point of the chuck wall and the domed panel is non-zero except at the center. The panel dome in cross section is formed by multiple radii that decrease with radial position from the panel center. For example, the panel dome radius R1 inboard and proximate the chuck wall is between 0.5 mm and 2 mm, the dome radius R4 at the center of the panel is between 35 mm and 55 mm, and the can end diameter is between 38 and 52 mm. Preferably radius R1 is between 0.5 mm and 4 mm, the radius R2 is between 7 mm and 20 mm, the radius R3 is between 28 mm and 41 mm, the radius R4 is between 35 mm and 55 mm, all for a can end diameter is between 38 and 52 mm. More preferably, R1, R2, R3, and R4 are between 0.7 mm and 2.0 mm, 10 mm to 16 mm, 31 mm to 37 mm, and 40 mm and 50 mm, and more preferably approximately 1.0 mm, 13 mm, 34 mm, and 44 mm for a 42 mm end.

Aspects of the end pour opening and tab include a pour opening defined by the score has a straight line dimension measured radially by a line that is inclined at an angle defined by opposite points of the pour opening of between 14 mm and 19 mm, more preferably between 15 mm and 17 mm. The horizontal clearance defined between the innermost part of the chuck wall and the outboard-most portion of the score is between 0.6 mm and 3.0 mm, preferably between 1.0 mm and 2.0 mm, and more preferably between 1.0 mm and 1.4 mm.

The finger clearance F defined between the innermost part of the chuck wall and distal-most portion of the tab heel measured on an incline is between 6 mm and 15 mm, more preferably between 7 mm and 10 mm.

The dome depth, measured from the top of the curl to the top of the panel at the center (but if the rivet is at the center then from a projection of the curve of the dome at the center) is preferably between 5 mm and 16 mm, more preferably between 6 mm and 10 mm, and in some embodiments shown approximately 8 mm. The dome depth can be chosen according to principles consistent with optimizing end performance along with desired diameters parameters.

Another embodiment that employs aspects of the present invention is a full aperture end. The full aperture end has a shell like the easy-opening end summarized above and formed by the processes summarized below, and has a score extends around a perimeter of the panel proximate the wall. A full aperture end may in some circumstances be made smaller than other styles, such as is approximately a 30 mm size, which the inventors surmise is a size that enables a smaller ring-type FAE tab with clearance for seaming.

According to another aspect of the invention, the unseamed end is seamed onto a can body. The unseamed can end and can body combination comprises: a drawn and ironed can body including a base, a sidewall, and a flange; and an unseamed can end. The unseamed can end includes a curl structure engaged with the flange; a chuck wall extending radially inwardly from the curl structure, the chuck wall is adapted for contact with a chuck during the seaming process; an inwardly domed panel radially inwardly from the chuck wall; a score formed on the panel; and a tab attached to the panel and adapted for rupturing the score in response to actuation of the tab by a user to form a pour opening.

The radial clearance between the flange proximate a neck of the can and the curl is at least 0.5 mm. The clearance may be measured at a chuck wall of the end. Consistent with the lightweight nature of the can end, the thickness of the can end measured at the curl structure is less than 10% or 20% thinner than the thickness of the flange. In part to accommodate a smaller curl, yet provide sufficient material for forming an adequate seam, the flange width less than 1.8 mm, preferably less than 1.6 mm, and more preferably less 1.5 mm, measured radially from an inboard side a vertical portion of a neck of the can to an outermost lip of the flange. And the curl height is greater than the width of the flange, such as by at least 0.5 mm, more preferably by at least 0.2 mm (or at all). The curl clearance dimension measured horizontally between an outermost tip of the flange and an innermost tip of the curl is between 0.4 to 1.2 mm.

The panel dimensions and configuration, tab and score, and other features for the combination end and can body are as described above with respect to the unseamed can end.

According to another aspect of the present invention, a container may employ inventive aspects of the seam consistent with the advantages of the end shell structure. In this regard, a container for holding a product comprises: a drawn and ironed can body including a base, a sidewall, and a neck; and a can end. The can end includes: a chuck wall extending radially inwardly from the curl structure, the chuck wall is adapted for contact with a chuck during the seaming process. The terminal portion of the can body and a terminal portion of the end being joined together by a double seam having a seam height that is less than approximately 2.2 mm and preferably is approximately 2.0 mm. The end may have an inwardly domed panel radially inwardly from the chuck wall; a score formed on the panel; and a tab attached to the panel and adapted for rupturing the score in response to actuation of the tab by a user to form a pour opening. Alternatively, the container may be a bottom end for an aerosol product.

The container preferably has thickness of a terminal portion of the end that is no more than a thickness of the terminal portion of the can body, and a seam thickness that is no more than 1.1 mm, more preferably no more than 0.96 mm, and preferably between 0.85 and 0.93 mm. Consistent with the thin end shell, the seam radius preferably is no more than 0.6 mm, more preferably no more than 0.55 mm.

The double seam on the container includes: (i) a cover hook, an end hook, a seaming panel, and a chuck wall of the terminal portion of the can body and (ii) a body wall and a body hook of the can end; an overlap between body hook and the cover hook preferably is between 0.65 and 1.2 mm, more preferably approximately 0.9 mm. The panel dimensions and configuration, tab and score, and other features of the end and can body are as described above with respect to the unseamed can end and the combination unseamed can end and can body flange.

For an example of a container that employs an inventive seam, the container includes a can body and a can end that includes: a chuck wall extending radially inwardly from the curl structure, the chuck wall is adapted for contact with a chuck during the seaming process; an inwardly domed panel radially inwardly from the chuck wall; a terminal portion of the can body and a terminal portion of the end being joined together by a double seam having a seam height that is less than approximately 2.2 mm. For this end, a score and tab are optional. The end preferably is formed of an aluminum alloy that is less than 0.20 mm thick, more preferably less than 0.18 mm thick, and in preferred embodiments less than 0.16 mm thick. This container may hold a comestible product or a product dispensed by a propellant.

According to another aspect of the present invention, a method of forming a can end shell capable of withstanding 85 psi after seaming to a can body, includes the steps of:

(a) clamping an end shell metal blank between an upper sleeve having a concave surface and a lower sleeve having a convex surface near a periphery of the blank;
(b) deforming the blank by engaging an upper surface of the blank with a dome-shaped punch and moving the punch relative to blank; and
(c) engaging an underside of the blank with a pressure sleeve assembly opposite a portion of the dome-shaped punch upon deformation of the blank in deforming step (b);

whereby the steps (b) and (c) resisting wrinkling.

In this regard, and throughout the specification, the terms "upper" and "lower", and related forms of the words, refer to positions relative to the finished end—such that upper refers to a position relative to or a direction toward the outer portion of the end, and lower refers to a position relative to or direction toward with the inner side of the end, when the end is on the can—rather than position in the tooling. Thus, the tooling components and method steps defined herein apply to the end regardless of its orientation in the tooling.

The pressure sleeve assembly of the engaging step (c) includes an outer pressure sleeve and an inner pressure sleeve, and in the engaging step (c) the inner pressure sleeve contacts an underside of the blank in response to relative movement by the punch, and the outer pressure sleeve contacts an underside of the blank after the inner pressure sleeve contacts the blank. The inner pressure sleeve has a contact surface having a shape that matches the shape of an opposing local portion the dome-shaped punch, and the outer pressure sleeve having a contact surface that matches the shape of an opposing portion of the dome-shaped punch.

The inner pressure sleeve and outer pressure sleeve are independently depressible such that during a first phase of the engaging step (c) the inner pressure sleeve is depressed by the relative downward movement of the punch while the outer pressure sleeve stays relatively stationary and spaced apart from the blank and during a second phase of the engaging step (c) each one of the inner pressure sleeve and outer pressure sleeve contact the underside of the blank and each one of the inner pressure sleeve and the outer pressure sleeve are depressed by the relative downward movement of the punch. The term "depressed" as used herein refers to compressed from its rest position. Preferably, springs are employed but other means are contemplated.

Preferably, the clamping step (a) includes forming a pre curl near the periphery of the blank by forced applied between the upper sleeve and the lower sleeve. The clamping step (a) may include forming a slight curl near the periphery of the blank by forced applied between the upper sleeve and the lower sleeve.

Preferably, the method includes a step of curling the periphery of the blank that is output from the shell press processes to form a finished curl capable of being seamed onto a can body flange. The curling step preferably is a two step process, each process performed in its own tooling.

A shell press for forming a can end shell capable of withstanding 85 psi after seaming to a can body, the shell press includes: a central dome-shaped punch; a pressure sleeve assembly located opposite a portion of the dome-shaped punch, the pressure sleeve having a contact surface that matches a corresponding opposite portion of the dome-shaped punch, the pressure sleeve being adapted for movement in response to movement of the dome-shaped punch such that the pressure sleeve contact surface and the corresponding opposite portion of the dome-shaped punch are adapted to deform a metal blank into a dome in response to downward movement of the dome-shaped punch; an upper sleeve concentrically located outboard of the dome-shaped punch, the upper sleeve having a concave contact surface; a lower sleeve concentrically located outboard of the pressure sleeve, the lower sleeve having a convex contact surface; the lower sleeve contact surface and the upper sleeve contact surface are adapted for curling a portion of a periphery of the blank; a punch sleeve concentrically located outboard of the upper sleeve; and a pressure pad concentrically located outboard of the lower sleeve.

The pressure sleeve assembly includes an outer pressure sleeve and an inner pressure sleeve. The inner pressure sleeve is concentrically located inboard of the outer pressure sleeve, and the inner pressure sleeve has a contact surface that matches a corresponding opposite portion of the dome-shaped punch. The outer pressure sleeve has a contact surface that matches a corresponding opposite portion of the dome-shaped punch. Each one of the inner pressure sleeve and the outer pressure sleeve is downwardly moveable in response to downward movement of the dome-shaped punch, such that the inner pressure sleeve and the outer pressure sleeve being independently moveable downwardly.

The inner pressure sleeve and the outer pressure sleeves are configured such that the inner pressure sleeve contacts a deformed portion of the blank before the outer pressure contacts a deformed portion of the blank. The tooling also includes a blanking tool concentrically located outboard of at pressure pad, wherein the punch sleeve and the lower pressure pad are adapted for vertical movement relative to the blanking tool to cut the blank from a metal sheet.

The structure and function of the unseamed and seamed can ends is included by reference in this summary of the method and tooling. The method and tooling have the goal and feature of forming the end shell without significant, which as used herein refers to a degree of wrinkling consistent with how the term is used by persons familiar with end shell structure, function, and seaming, and is meant to refer to a commercially acceptable product upon mass production. The method and tooling are particularly adapted to thin shells formed of aluminum alloys that are less ductile than steel ends used in aerosol packaging.

The method and tooling may be employed without regard to the material or end use, and thus encompasses aluminum, steel or other metal blanks, an end products for food, beverage, or aerosol containers, unless expressly stated in the claims. Moreover, all aspects of the structure and function of the products described herein apply to the description of the tooling and methods, and all aspects of the tooling and methods described herein apply to the structure and function of the products, to the extent that consistency and logic permits.

DESCRIPTION OF PREFERRED EMBODIMENTS

Figure 1:
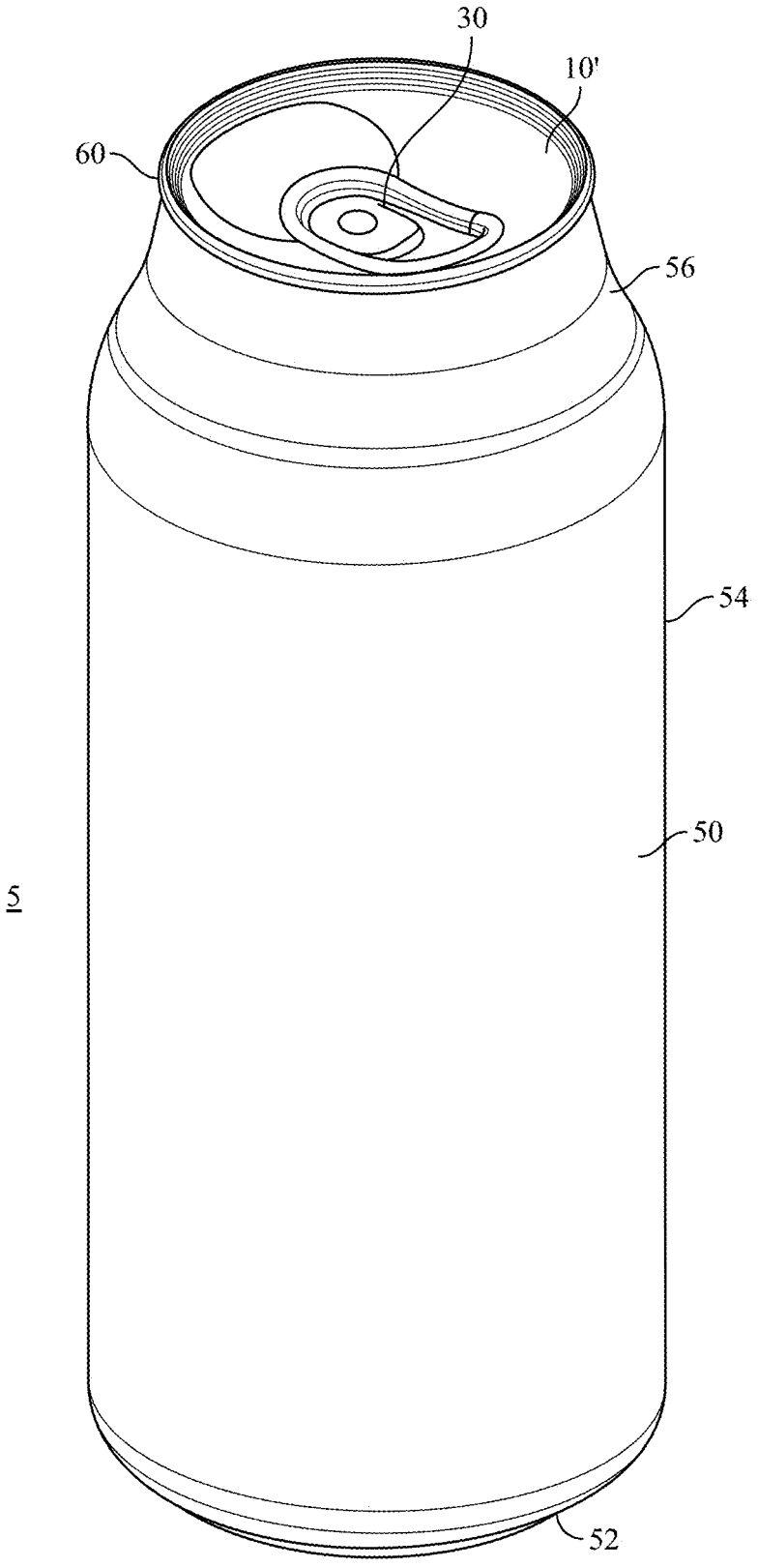
FIG. 1 is a perspective view of a can and can body package, illustrating an embodiment of the present invention.
Figure 2:
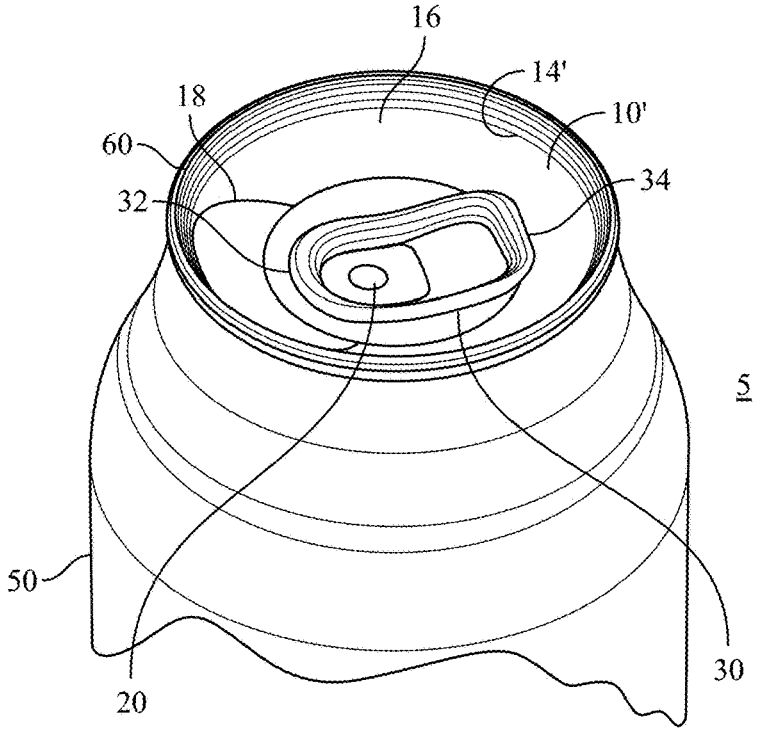
FIG. 2 is an enlarged perspective view of a portion of the package embodiment of FIG. 1.
Figure 3:
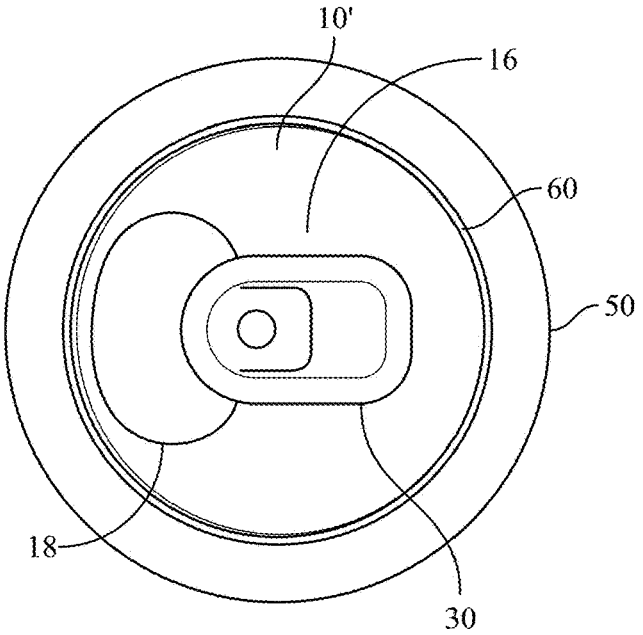
FIG. 3 is a top view of the package embodiment of FIG. 1.

Referring to the figures, a container package, such as package 5, includes a beverage can end 10 and a can body 50. End 10 in its unseamed configuration, as shown for example in FIG. 15, includes a curl 12 at its outer periphery, a wall 14, sometimes referred to as a chuck wall, extending radially inwardly and downwardly from the curl 12, and an inwardly or concave curved panel 16 extending smoothly from the lower end of wall 14. The seamed end and some components are referred to by using a prime designation, such as seamed end 10' and seamed chuck wall 14'. The unseamed end and some of its components of the unseamed end are referred to by reference numbers without a prime designation, such as unseamed end 10 and its chuck wall 14. As explained below, where convenient to the illustration, some components of end 10 are omitted, and reference numerals 8 and 9 are used to refer to shells before they are finalized to form end 10.

A tear panel is formed by a score 18, which after actuation by tab a 30 forms a pour opening. Score 18 may be formed by conventional methods and tooling, but as applied to curved panel 16, as will be understood by persons familiar with can end technology in view of the present disclosure. Tab 30 is attached to panel 16 by a rivet 20 (preferably conventional) at a rivet island. Tab 30 is curved at approximately the same curvature as panel 16 in the embodiment shown. Tab 30 includes a nose 32 for contacting the tear panel during the opening process and an opposing 36 heel for grasping by a user to actuate the tab.

Figure 5:
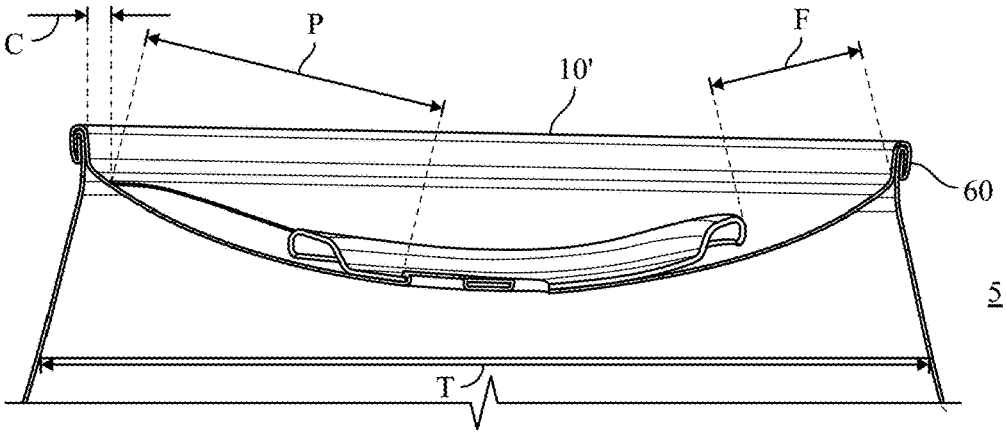
FIG. 5 is an enlarged cross sectional view of a portion of the package embodiment of FIG. 1.

As illustrated in FIG. 5, a pour opening defined by score 18 has a straight line dimension P, measured radially by a line that is inclined and defined by opposing points of the opening, of preferably between 14 mm and 19 mm, more preferably between 15 mm and 17 mm. The clearance C between the radially innermost part of the chuck wall and the outboard-most portion of the score (that is, the minimum or closest point between score and the chuck wall) measured horizontally is preferably between 0.6 mm and 3.0 mm, more preferably 1.0 mm and 2.0 mm, and preferably between 1.0 mm and 1.4 mm.

The 42 mm can size is illustrated in FIG. 5 by dimension DIA—that is, dimension DIA of the end shown in FIG. 5 is 42.0 mm, which is the seamed end diameter measured on the outboard surface of the wall, which is interior in the seam where the neck extends from the seam. An end to end tab length T is 23.6 mm (measured horizontally), which is near a minimum for conventional tab opening processes, even though the invention should not be limited to any tab dimension unless expressly stated in the claim. Finger access clearance F for a user to access tab heel 36 is defined by an inclined, straight line between the outermost point on the tab heel and the bottom of wall 14' of seam 60. Finger access distance F preferably is between 6 mm and 15 mm, more preferably between 6 mm and 12 mm, more preferably between 7 mm and 10 mm, and as shown in FIG. 5, 8 mm. The ddimensions provided for the 42 mm end of FIG. 5 disclose preferred embodiments, and it is understood that the dimensions (such as without limitation pour opening dimension P, clearance dimension C, finger access dimension F, and tab length T) may also apply to ends of sizes other than 42 mm.

Figure 4A:
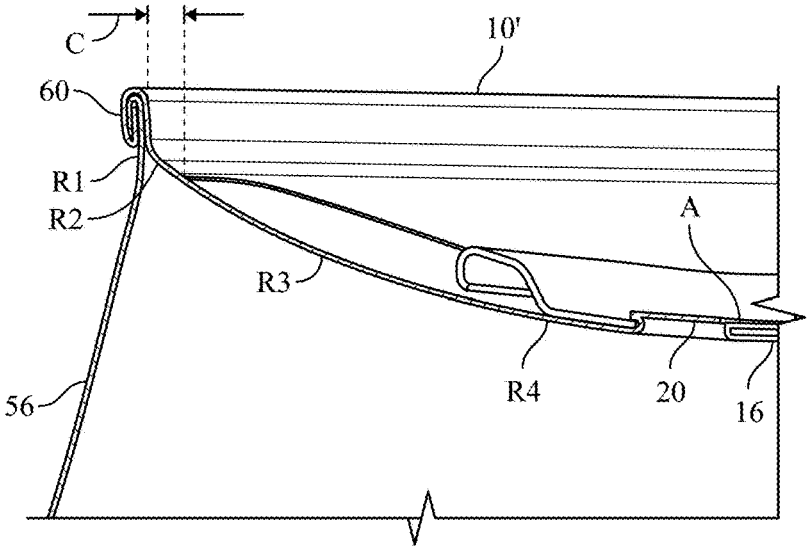
FIG. 4A is an enlarged cross sectional view of a portion the package embodiment of FIG. 1.

Panel 16 of unseamed end 10 defines a dome depth D of preferably between 6 mm and 12 mm, more preferably between 6 mm and 10 mm, and in the embodiment shown in the figures, 8 mm. Additional information is provided in Table 1. Dome depth D, as illustrated in FIG. 4A, is measured vertically from the uppermost part of curl 12 to the upper side of panel 16 at the center (or the lowermost point that it adjacent to the rivet if rivet 16 is located at the center).

Figure 8:
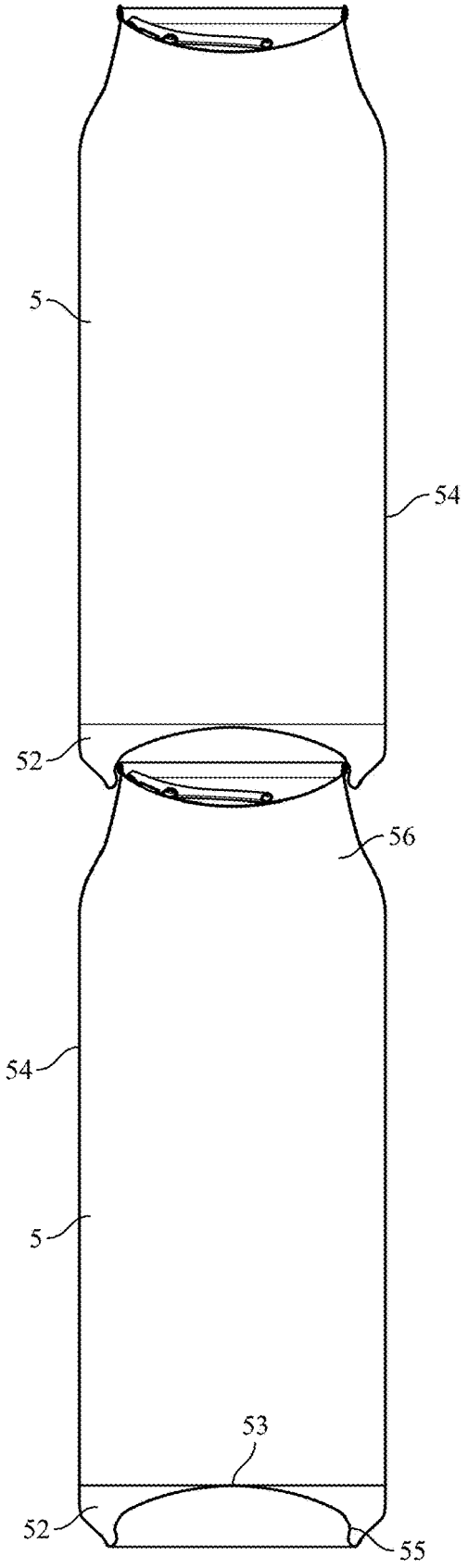
FIG. 8 is view of stacked containers shown in FIG. 1.
Figure 9:
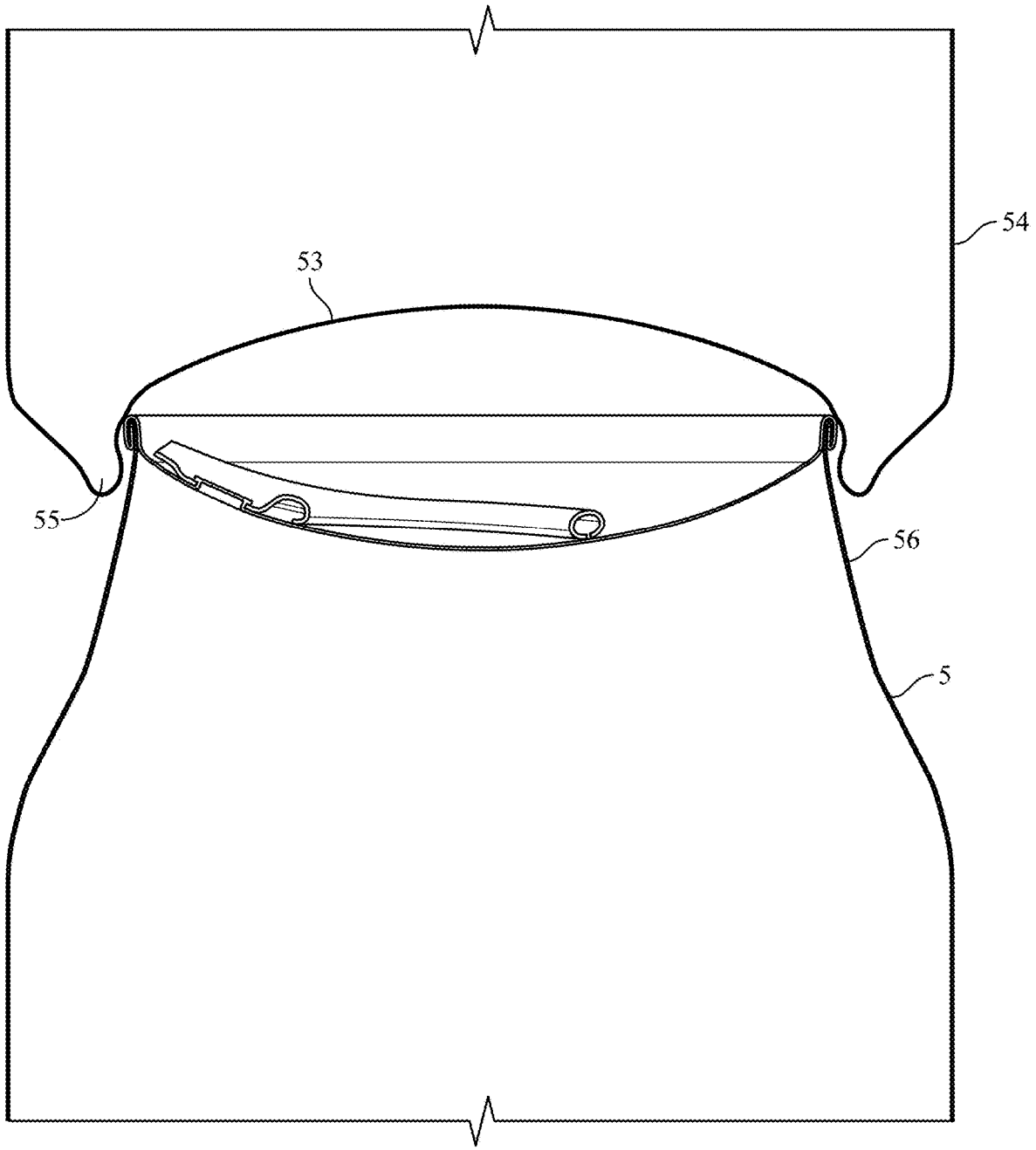
FIG. 9 is an enlarged view of a portion of FIG. 8.

Can body 50 in the embodiment shown in FIG. 1 is a drawn and wall ironed ("DWI") body having a domed base 52 and an integral sidewall 54. Base 52 includes a dome 53 and feet 55, as illustrated in FIGS. 8 and 9. Preferably, can body 50 is formed using conventional DWI processes.

Figure 15:
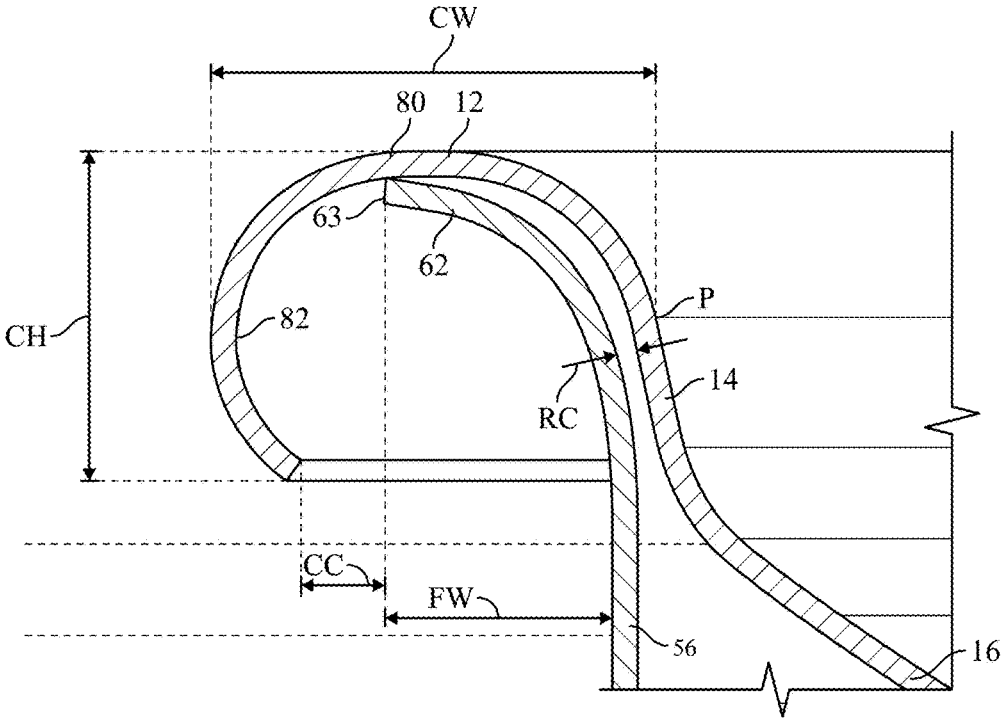
FIG. 15 is an enlarged view of a curl of the can end engaged with a can body flange.

A neck 56, which has a reduced diameter relative to sidewall 54, extends from an upper end of sidewall 54. It is understood that the magnitude of necking for package 5 may in some embodiments be greater than conventional 12 ounce beverage cans, as is known in the art. In the unseamed state, neck 54 terminates in a flange 62, as illustrated in FIG. 15.

Seam 60, which preferably is a double seam, joins end 10 and body 50. In the seamed state, all or most of curl 12 forms seam 60 and all of most of wall 14 forms the inboard surface of seam 60, as described more fully below. Preferably, as illustrated in FIGS. 8 and 9, seam 60 is insertable into the base of the can for stacking purposes. Container package shown in FIG. 8 is a 'Slim' can 50 having a conventional reformed base profile 52. End 10' in FIG. 8 is 42 mm end, which stacks internally on the base 52.

Figure 10:
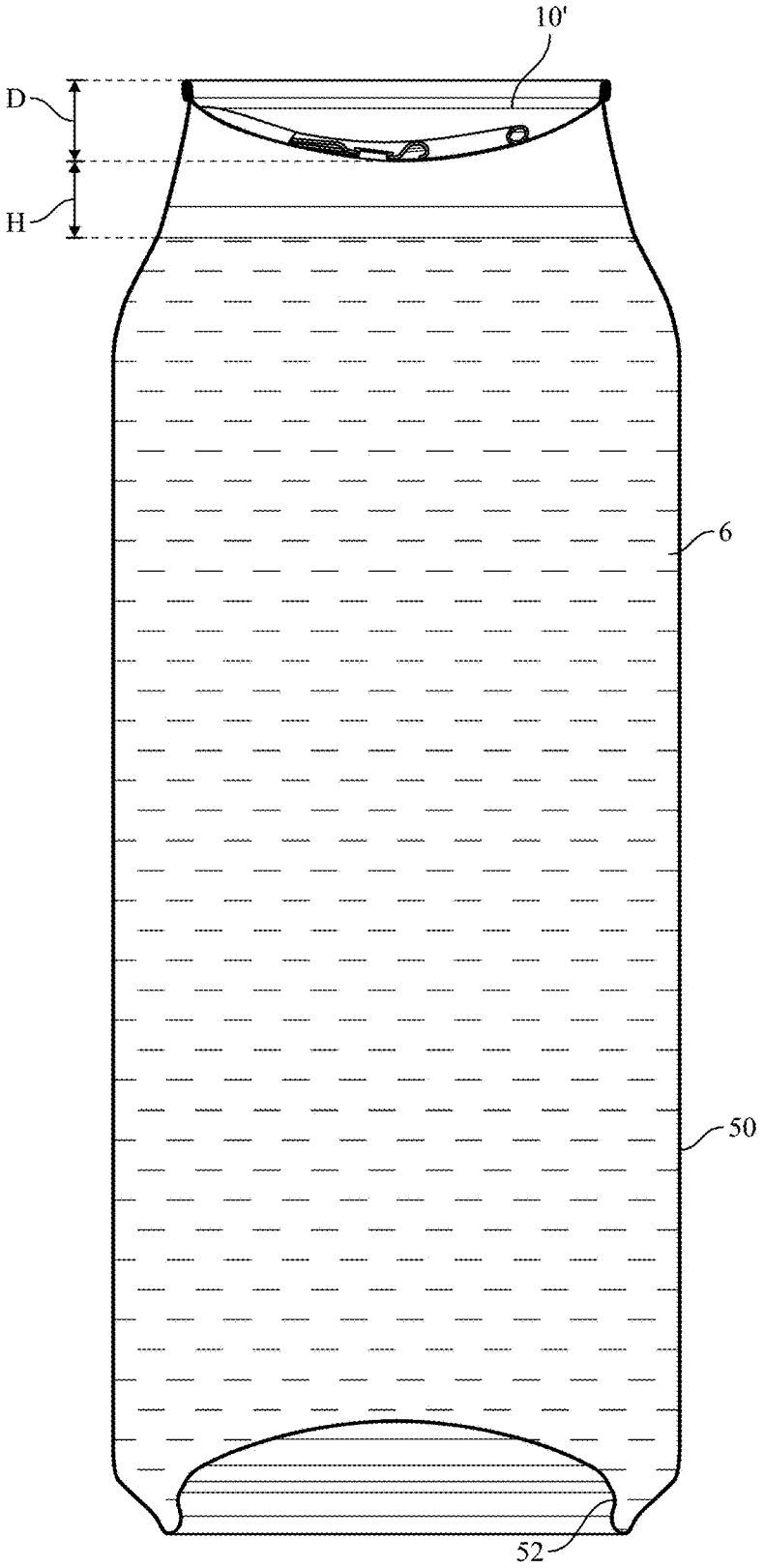
FIG. 10 is a cross section view of a package showing the beverage contents.

As illustrated in FIG. 10, package 5 has a vertical height H between liquid contents 6 of the container and top the seam of between 10 mm and 30 mm, preferably 14 mm. The present invention is not intended to be limited by dimension H unless expressly set out in the claims.

Figure 4B:
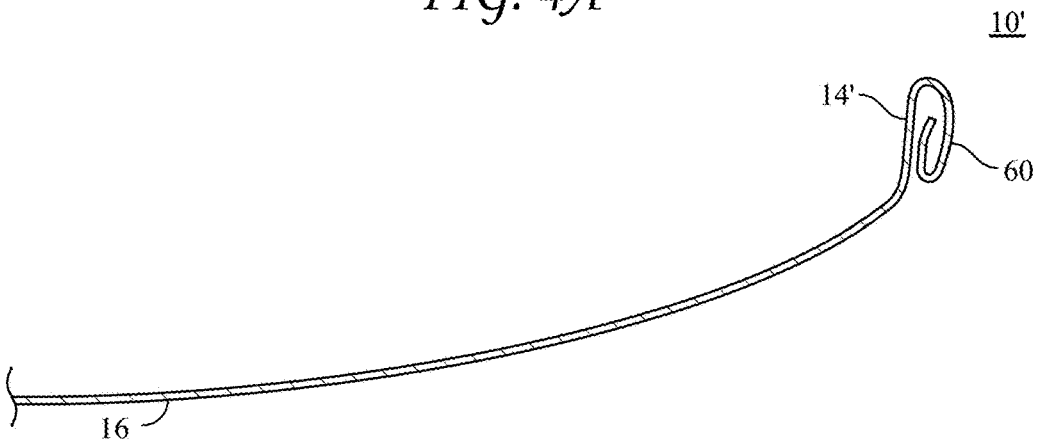
FIG. 4B is an enlarged cross sectional view of an end with the components of the can body and the tab and the score removed for clarity.

Referring particularly to FIGS. 1, 4A, and 4B, panel 16 smoothly extends from the bottom of wall 14 or 14', preferably, without a reinforcing structure, such as an upwardly opening groove or a folded or z-shaped groove. Preferably, the slope of the tangent of a curve of the panel 16 at every point is not zero except at the center or at the panel, where the slope changes from negative to positive. The present invention encompasses recesses and beads formed in the panel (not shown), according to well-known principles for optimizing score propagation and other parameters, as will be understood by persons familiar with conventional end technology in view of the present disclosure. A panel having such structure is intended to be encompassed by the terms dome-shaped, curve, or concave as used herein.

The dome 16 profile preferably comprises a series of progressively increasing radii from a small radius next to the chuck wall to a large central radius. The progressively increasing dome radii can minimise the depth of the curve, thus optimising material usage and providing a shallow dome depth. The shallow dome depth may in some configurations make it easier or feasible for the end to be manufactured using conventional metal forming processes without wrinkling during the drawing operation that might occur with very thin material.

For the example of a 42 mm end size, the preferred radius values for R1 through R4 (that is, from the outboard-most radius to the center radius) are 1, 13, 34 and 44 mm, as illustrated in FIGS. 4A and 4B. For the purpose of further defining embodiments of the invention, the preferred radius R1 between wall 14 and panel 16 may without limitation be in the range (for the 42 mm size end or other sizes) between 0.5 mm and 4 mm, preferably 0.7 mm and 2.0 mm, and in the 42 mm embodiment shown 1.0 mm. R1 merges into a radius R2 that is between 7 mm and 20 mm, preferably 10 mm to 16 mm, and most preferably approximately 13 mm. R2 merges into radius R3 that is between 28 mm and 41 mm, preferably 31 mm to 37 mm, and most preferably approximately 34 mm. Radius R3 merges into dome radius R4 at the center that preferably is between 35 mm and 55 mm, preferably between 40 mm and 50 mm, and most preferably approximately 44 mm.

Can ends having the above ranges of radii are for the preferred embodiment of a 42 mm end size. The can end may also have a diameter between 38 mm and 52 mm, or 40 mm and 46 mm. Moreover, the general shape of the end structure disclosed herein, including the ratio of end diameter to height and seam dimensions, may be used with much larger ends, such as up to and including 82 mm diameter ends currently used for 1 liter beer cans. The present invention is not limited to the particular radii ranges or number of ranges unless stated in the claims. Rather, it is understood that the dome may elliptical or formed by a series of splines, or other shape.

Figure 14:
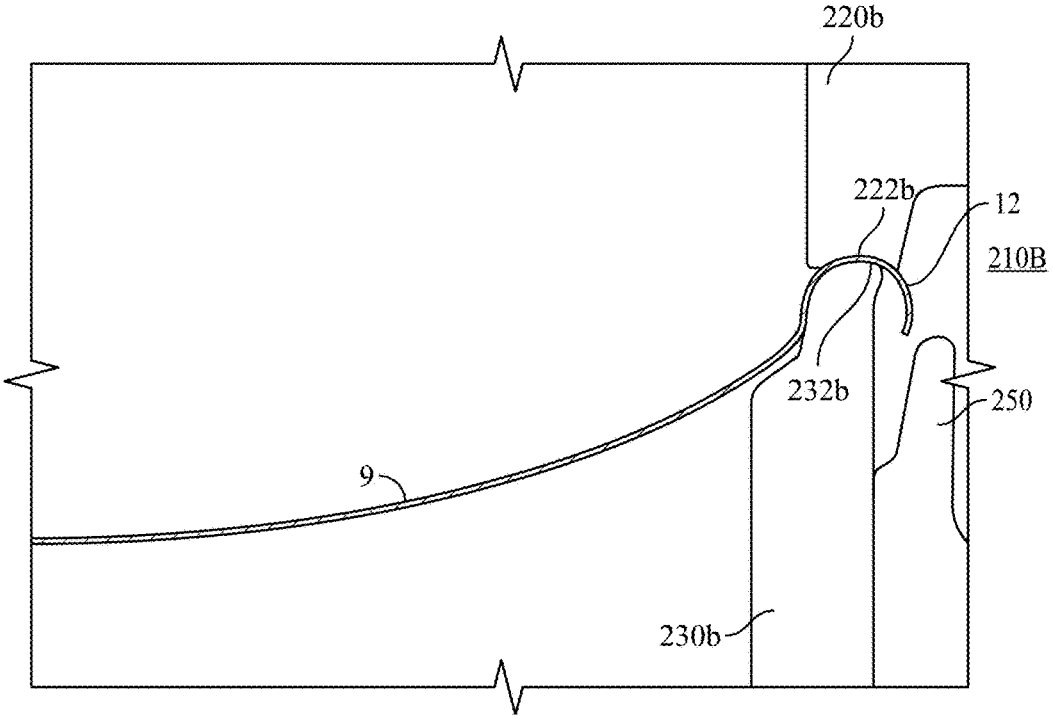
FIG. 14 is a view of the end shell shown in FIG. 13 after the second curling process has formed the pre-curl into a curl.
Figure 24:
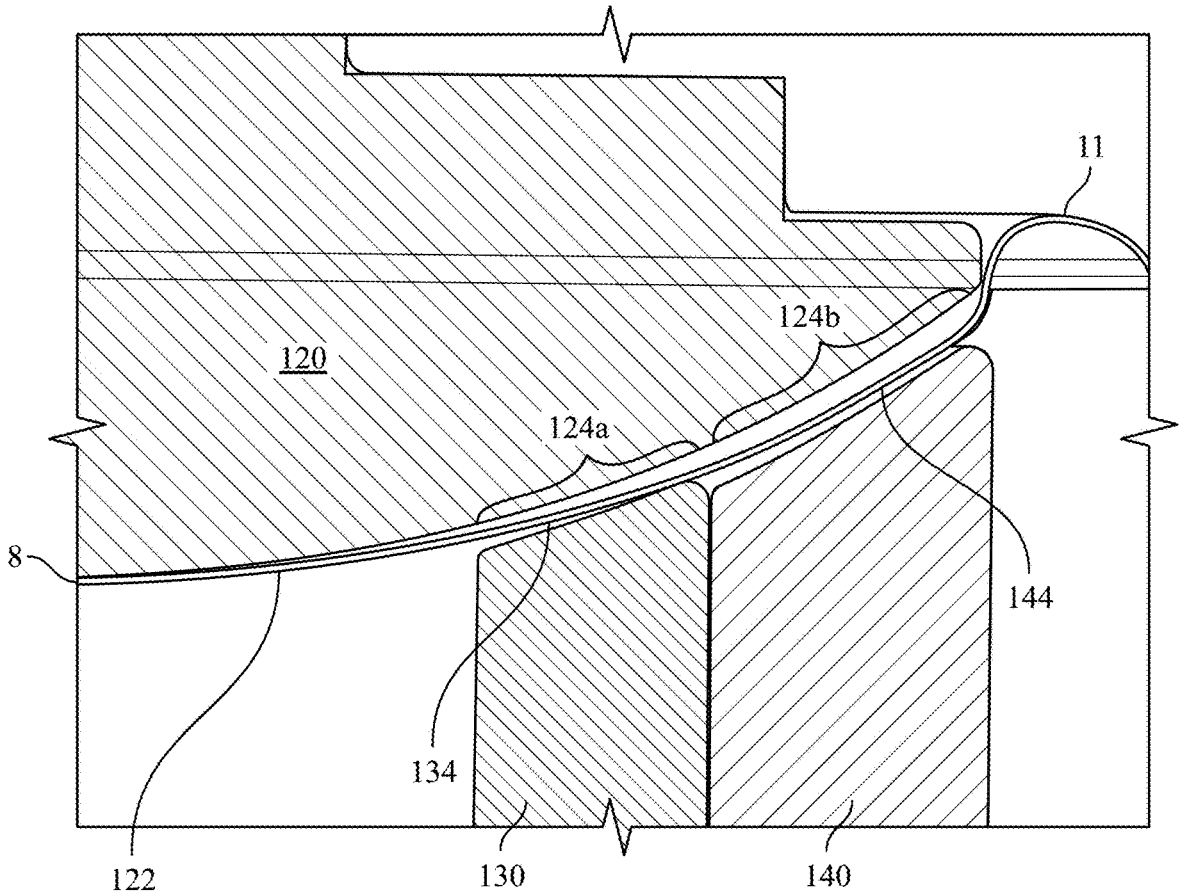
FIG. 24 is an enlarged cross sectional illustration of a portion of the tooling engaged with the end.

FIGS. 14 and 24 are exemplary embodiments of a curled shell profile (9) or 10) of the 42 mm size having the preferred values of R1, R2, R3, and R4, which radii diminish from chuck wall 14 to the center of panel 16. The particular curves may for other sizes, such as 46 mm and 50 mm ends, may be optimized according in a straightforward way according to the principles explained in the present disclosure, as will be understood by persons familiar with can end technology.

Table 1 below provides values of some parameters for the 42 mm, 46 mm, and 50 mm ends, which values are the products of finite element analysis design and optimization. The "constrained" values control some parameters, such as freeboard height H of the package and dome height D. The "free" values are the optimized parameters without external constraints applied to the solution, and thus better reflect the benefits of the improvement of the end technology disclosed and claimed herein.

TABLE 1

Finite Element Analysis Results

| Design | Dome height | Shell thickness | Cutedge diameter | Mass | Dome height | Reversal Pressure | Wt saving from 50 ISE | % Wt saving from 50 ISE | Dia Shell | Dome dia/ht |
|---|---|---|---|---|---|---|---|---|---|---|
| 50Eden | Constrained | 0.221 | 64.007 | 1.906 | 8.226 | 94.43 | 0.06 | 3% | 50 | 6.1 |
| 50Eden | Free | 0.1773 | 65.344 | 1.594 | 10.93 | 103.1 | 0.38 | 19% | 50 | 4.6 |
| 46Eden | Constrained | 0.1896 | 59.65 | 1.42 | 7.976 | 98.53 | 0.55 | 28% | 46 | 5.8 |
| 46Eden | Free | 0.173 | 59.9 | 1.307 | 8.42 | 97.64 | 0.66 | 34% | 46 | 5.5 |
| 42Eden | Constrained | 0.1583 | 56.218 | 1.053 | 7.957 | 99.07 | 0.92 | 47% | 42 | 5.3 |
| 42Eden | Free | 0.1583 | 56.218 | 1.053 | 7.957 | 99.07 | 0.92 | 47% | 42 | 5.3 |

Shell thickness is the starting gauge in millimeters of 5000 series aluminium alloy. Cut edge diameter is the blank diameter in millimeters. Mass is the mass of the shell reflecting the cut edge diameter. Dome height is dimension D explained herein. Reversal pressure is the calculated pressure in PSI that the dome profile reverses. The weight savings is a percentage metal weight savings compared with a 50 mm end marketed by Crown Cork & Seal, Inc. as its "ISE" end, which is well known in the field. Shell diameter is the diameter in millimeters, such as indicated in FIG. 5 as DIA. Dome diameter to height is the ratio of those parameters, which provides guidance for the proportions of ends formed according to the disclosure herein for sizes larger and smaller than those set out in this specification. Accordingly, the inventors surmise that the diameter of the can end is less than 10 times a height D of the dome, and preferably between 4 and 8 times a height D.

Figure 6:
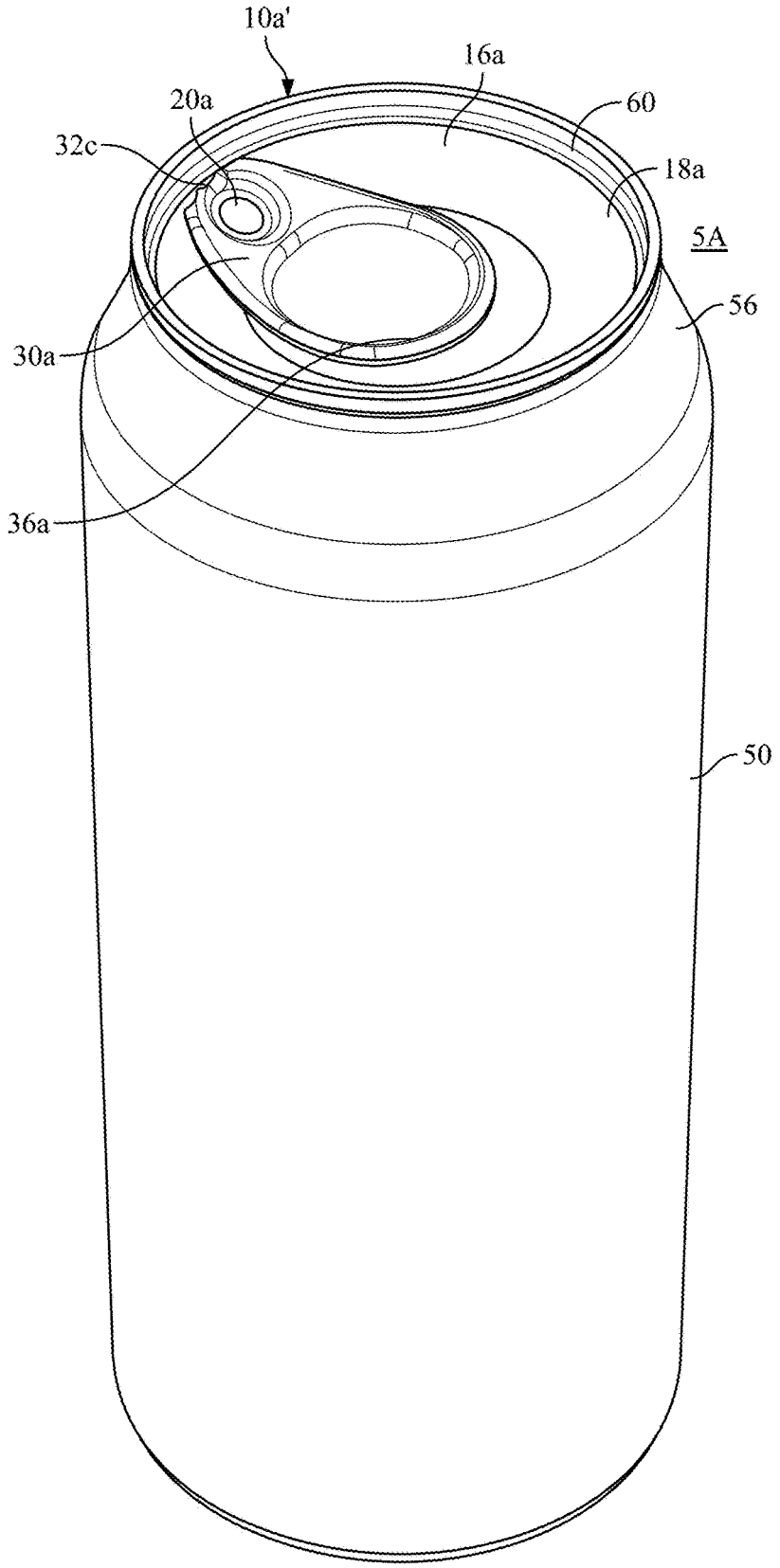
FIG. 6 is a perspective view of another embodiment of a beverage can package, showing a full aperture end.
Figure 7:
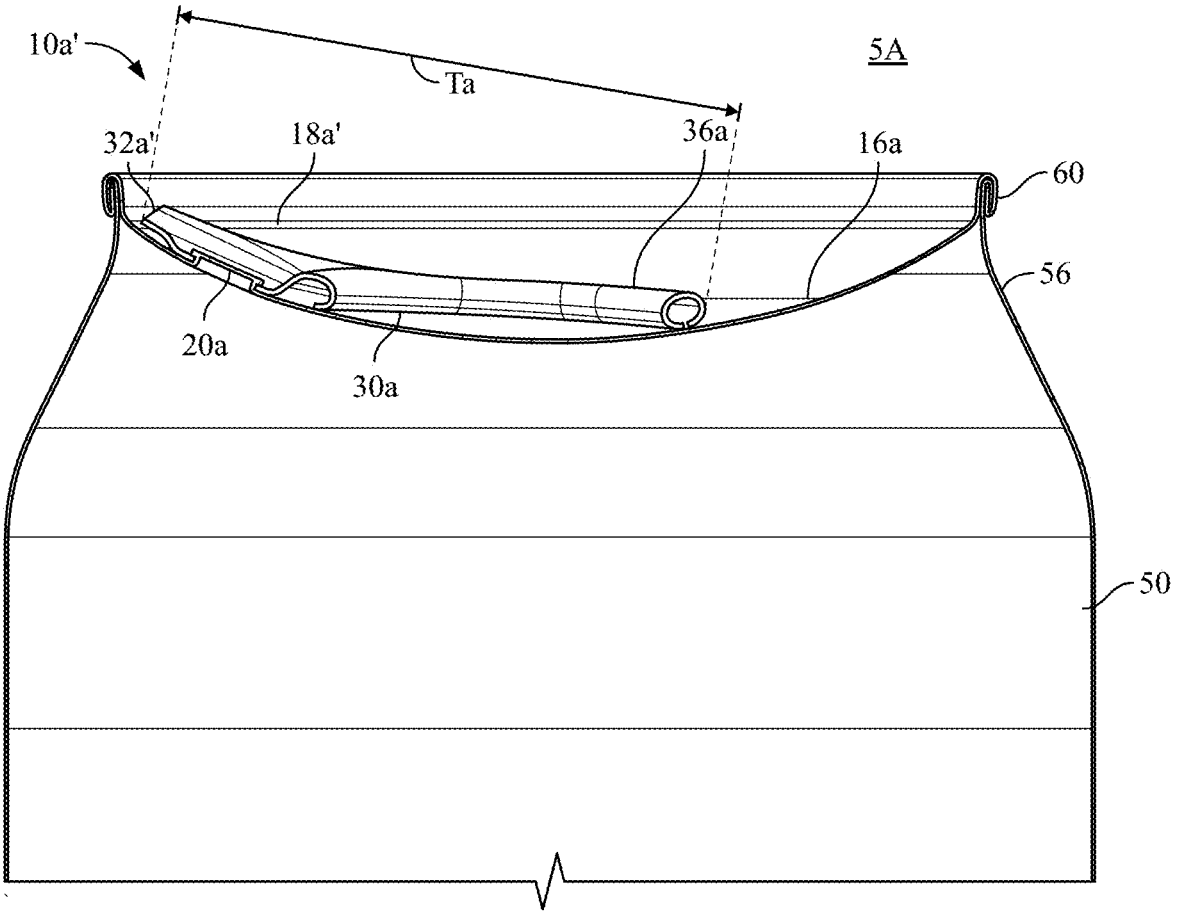
FIG. 7 is an enlarged, partial cross sectional view of the package of FIG. 6.

FIGS. 6 and 7 illustrate another embodiment of a full aperture container package 5A that includes a beverage can end 10*a*' and a can body 50. Seam 60, and thus curl 12 and wall 14 are as described for first embodiment can end 10, 10'. End 10*a*' thus includes a panel 16*a* that has a score 18*a* formed about its periphery proximate the base of wall 14'. A tab 30*a* is attached to panel 16*a* by a rivet 20*a*. Tab 30*a* preferably is curved at approximately the same curvature as panel 16*a* in the embodiment shown. Tab 30*a* includes a nose 32*a* for contacting the tear panel during the opening process and an opposing ring 36*a* for grasping by a user to actuate the tab.

The preferred minimum length T-a for tab 36*a* is 27 mm to enable a rivet and a finger to be insertable into ring 36*a*. Thus, end 10*a*, 10*a*' can be made as small as about 30 mm, which dimension provides clearance around tab 36*a* for seaming tooling.

Can body 50 is as described for first embodiment container package 5. And the dome profile of panel 16*a* is as described for first embodiment container package 5. As rivet 20*a* is within score 18*a*, actuation of tab 30*a* and rupture of score 18*a* fully around the perimeter of panel 16*a* enables the tear panel to be fully removed from the remainder of the container package 5*a*. Such configuration is referred to a full aperture end.

Figure 11:
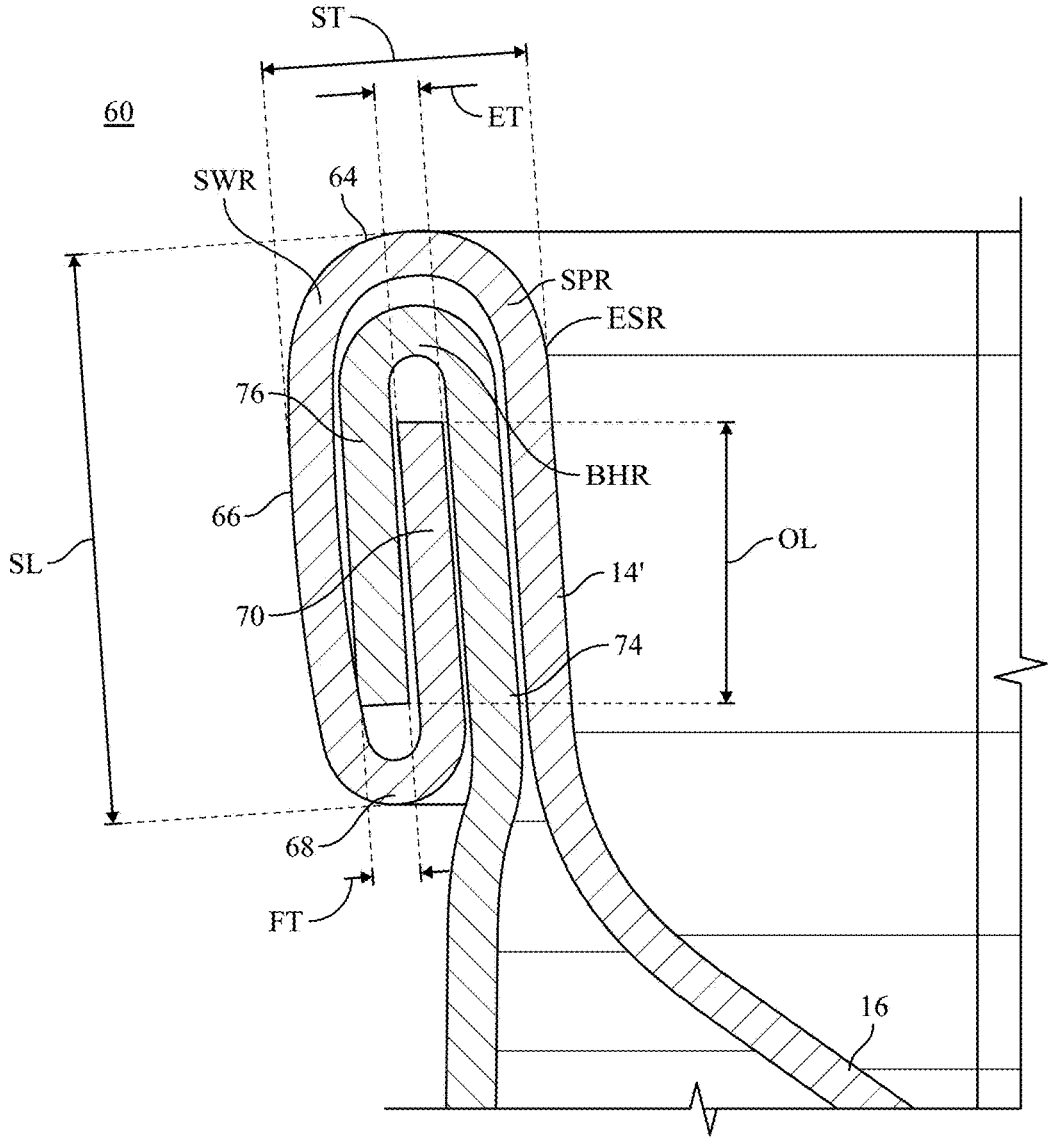
FIG. 11 is an enlarged cross sectional view of a seam according to an aspect of the invention and employed in the embodiment of FIG. 1.

Referring to FIG. 11, seam 60 includes portions formed by a terminal portion of end 10' and portions formed by terminal portions of the can body flange. Portions of the end that form seam 60 include chuck wall 14', a seaming panel 64, a seaming wall 66, an end hook 68, and a cover hook 70. A junction between wall 14' and seaming panel 64 defines a seaming panel radius SPR. A junction between seaming panel 64 and seaming wall 66 defines a seaming wall radius SWR. Portions of the can body that form seam 60 include a body wall 74 and a body hook 76. A junction between body wall 74 and body hook 76 define a body hook radius BHR.

Figure 19:
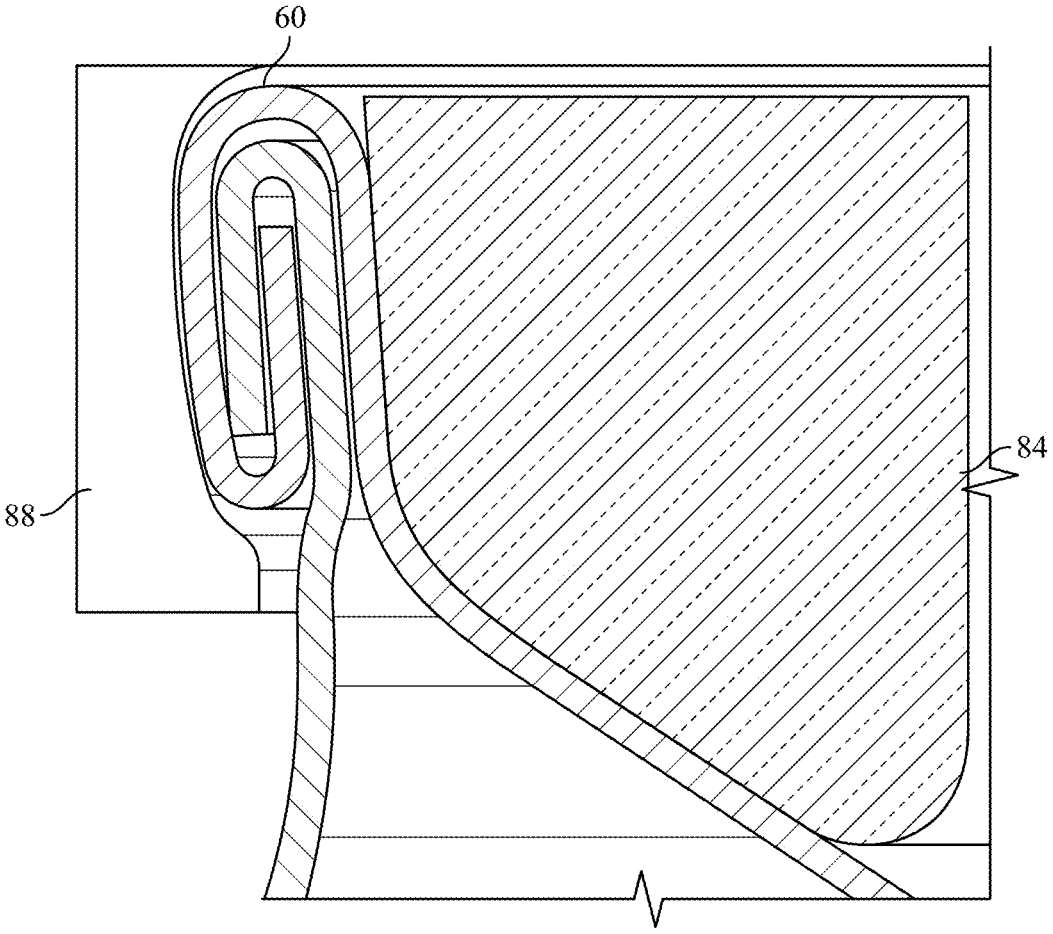
FIG. 19 is another view of the can end and flange upon completion of the seaming process.

Wall 14', as shown for example in FIGS. 11 and 19, is inclined according to the seaming chuck configuration and seaming process. For example, wall 14' may be inclined in the seamed state by 1 to 8 degrees, and preferably about 4 degrees. Wall 14 in its unseamed state in FIG. 15 may be any shape or configuration that produces the finished wall 14', and preferably is about 4 degrees.

According to an aspect of the present invention, the structure of end 10 enables thinner material to be employed, which in turn enables a smaller seam than conventional beverage can double seams to be employed. In this regard, the inventors are not aware of any commercial aluminum package having a double seam formed by an end material that is thinner than or has a similar thickness to the can flange material. In particular, the domed end thickness is no more than 20% greater than the curl thickness, preferably less than 10% thicker than the curl. The benefit of this compact geometry is that the end seam radius is small and this locks the seam in place during pressurization, thus preventing seam unravelling As the material is very thin it is more susceptible to unravelling thus the locking effect is critical for the buckle performance.

Preferably, curl thickness is 0.16 mm, which is significantly less that any of the curl thicknesses of any conventional ends.

Further, seam length L, measured from the uppermost point of the seam to the lowermost point on the seam along the seam centerline, is preferably below 2.2 mm, and in the preferred embodiment is approximately 2.0 mm. Seam thickness ST, measured at widest point of the outboard surfaces of wall 14' and seaming wall 66 perpendicular to the longitudinal axis of the seam, preferably is no more than 1.1 mm, more preferably no more than 0.96 mm, and in the embodiment shown dimension ST is approximately 0.85 to 0.93 mm. The end seam radius ESR, measured at the top of the seam and reflected either by the seaming panel radius SPR or the seaming wall radius SWR preferably is no more than 0.6 mm, more preferably no more than 0.55 mm, and even more preferably no more than 0.5 mm. Further, an overlap dimension OL between body hook 76 and the cover hook 70 is between 0.65 and 1.2 mm, and preferably approximately 0.9 mm.

Referring again to FIG. 15, unseamed end 10 is in position on can body 50 ready for the seaming process. In this regard, curl 12 includes a seaming panel 80 and a peripheral curl 82 such that end seaming panel 80 is in contact with a tip of flange 62. The radial clearance RC between the flange proximate a neck of the can and the curl, measured at its narrowest point and preferably at chuck wall 14, is at least 0.5 mm. Dimension RC and other dimensions referred to herein as "radial" are measured horizontally.

Aspects of the smaller seam dimensions and end thicknesses (compared with prior art), and the like, are reflected in the unseamed configuration of end 10 and can flange 62. Flange width FW is large enough to form an adequate overlap dimension OL for acceptable seaming. Flange width FW is measured radially from an inboard side a vertical portion of neck 56 to an outermost lip 63 of the flange and preferably is no more than 1.8 mm, more preferably, no more than 1.6 mm, and preferably about 1.5 mm. A curl width dimension, measured radially and horizontally between the outboard most point of the curl structure and the point on the curl at which a seaming panel of the curl structure yields to a relatively straight portion of a chuck wall of the end, preferably is less than 3.5 mm, more preferably less than 3.0 mm, and in the embodiment shown 2.8 mm. For ease of measurement, the curl width CW can be measured from the outermost point on the curl radially (that is, horizontally when viewed in cross section) to a point P on the inboard surface of the end at curl 12 or wall 14.

Curl height CH preferably is greater than flange width FW, which the inventors believe is contrary to conventional dimensional relationships in commercial beverage cans. Preferably, height CH is greater than flange width FW by at least 0.2 mm, and more preferably by at least 0.5 mm. In the embodiment shown, curl height is 2.1 mm. A curl clearance dimension CC measured horizontally between an outermost tip of the flange and an innermost tip of the curl is between 0.4 to 1.2 mm, and preferably is approximately 0.5 mm.

Figure 17:
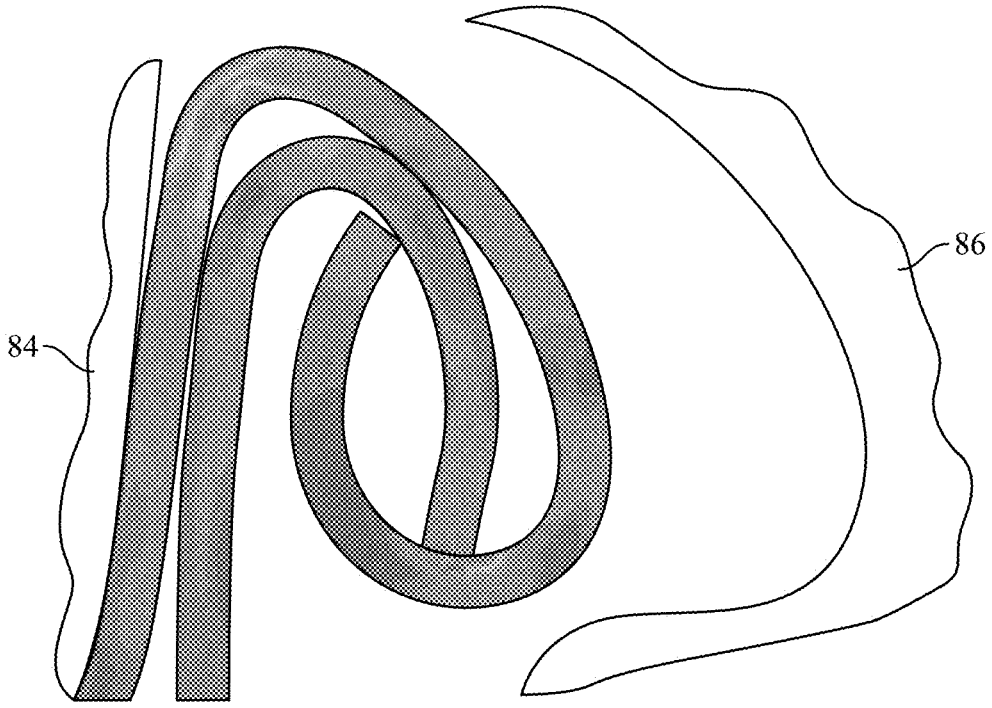
FIG. 17 illustrates the can end curl and can body flange after a first seaming operation.
Figure 18:
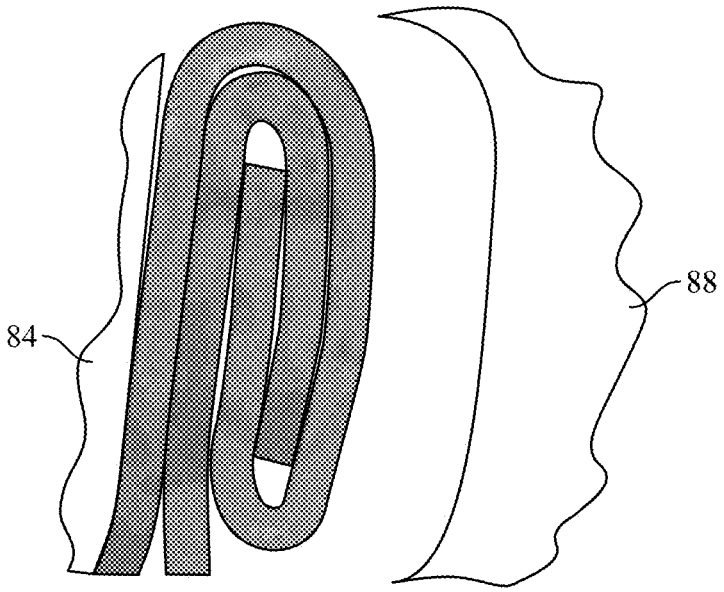
FIG. 18 illustrates the can end curl and can body flange after a second seaming operation.

FIGS. 17 and 18 illustrate a seaming chuck 84 engaged with end 10 to form seam 60 for the 42 mm end. FIG. 17 shows first seaming roll 86 after it has retracted upon the first seaming operation. FIG. 18 shows second seaming roll 88 after it has retracted upon the second seaming operation. FIG. 19 is a cross sectional view of second roll 88 engaged with seam 60.

Figure 16:
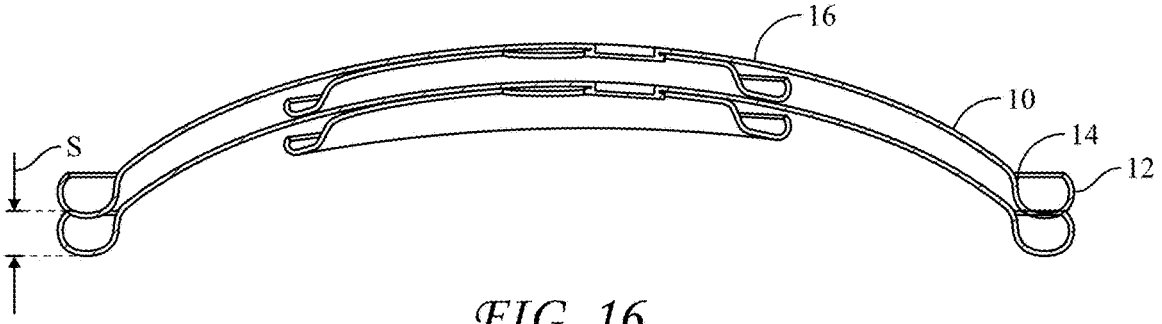
FIG. 16 is a cross section view of unseamed can ends in a stacked configuration.

As best shown in FIG. 16, the unseamed end 10 has a stacking height S of between 1.5 and 3.0 mm, more preferably between 1.6 and 2.2 mm, and in the embodiment shown 1.8 mm.

As illustrated in FIGS. 20 through 24, a shell press 100 includes a tool pack 110 for forming end shells described herein. For convenience of description, conventional parts of shell press 100, such as those related to moving sheet material, and related to moving and aligning the tool pack 110, are omitted from this description and will be understood by persons familiar with shell press technology based on the description of tool pack 110 and the shell product. For illustrating the tooling and process for forming end 10, reference number 8 will refer to the product of shell press 100 (that is, the domed shell) and reference number 9 will refer to the finished shell after a first curling operating, but before entering the next process (that is, the product having curl 12, wall 14, and panel 16, but not including a score, rivet, or tab).

Tool pack 110 includes a dome-shaped punch 120, a pair of pressure sleeves 130 and 140, an upper sleeve 150, a die center ring 160, a punch sleeve 170, a pressure pad 180, a cut edge 190, and a stripper hold down tool 200. Punch 120 has a dome-shaped surface 122 that approximately matches the profile of panel 16, accounting for some spring back. The calculated profile of shell 8 is illustrated in FIG. 24. Inner pressure sleeve 130 and outer pressure sleeve 140 are opposite punch 120 and have contact surfaces 134 and 144 that match the curvature and orientation of corresponding portions 124*a* and 124*b* of punch 120. Upper sleeve 150 has a concave contact surface 152 on its lowermost end. Die center ring 160 has a convex contact surface 162 on its uppermost end.

Upper sleeve 150 is aligned with the die center ring 160 and is concentric with punch 120. Die center ring 160 is concentric with outer pressure sleeve 140. Punch sleeve 170 is aligned with pressure pad 180 and is concentric with upper sleeve 150. Pressure pad 180 is concentric with lower sleeve 160.

Figure 20:
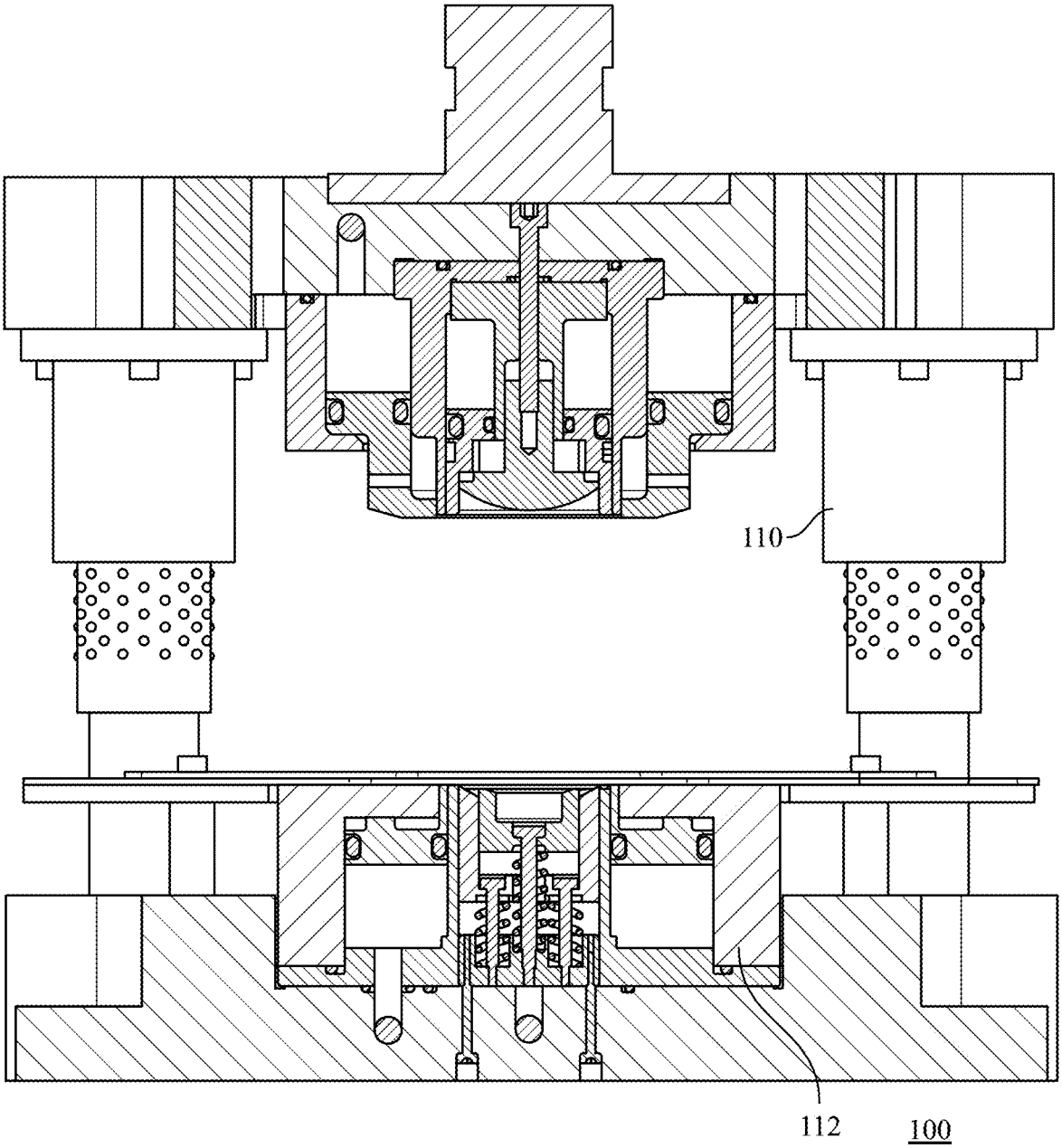
FIG. 20 is a side and partial cross sectional view of the shell press tooling assembly shown in an open tool pack position.
Figure 21:
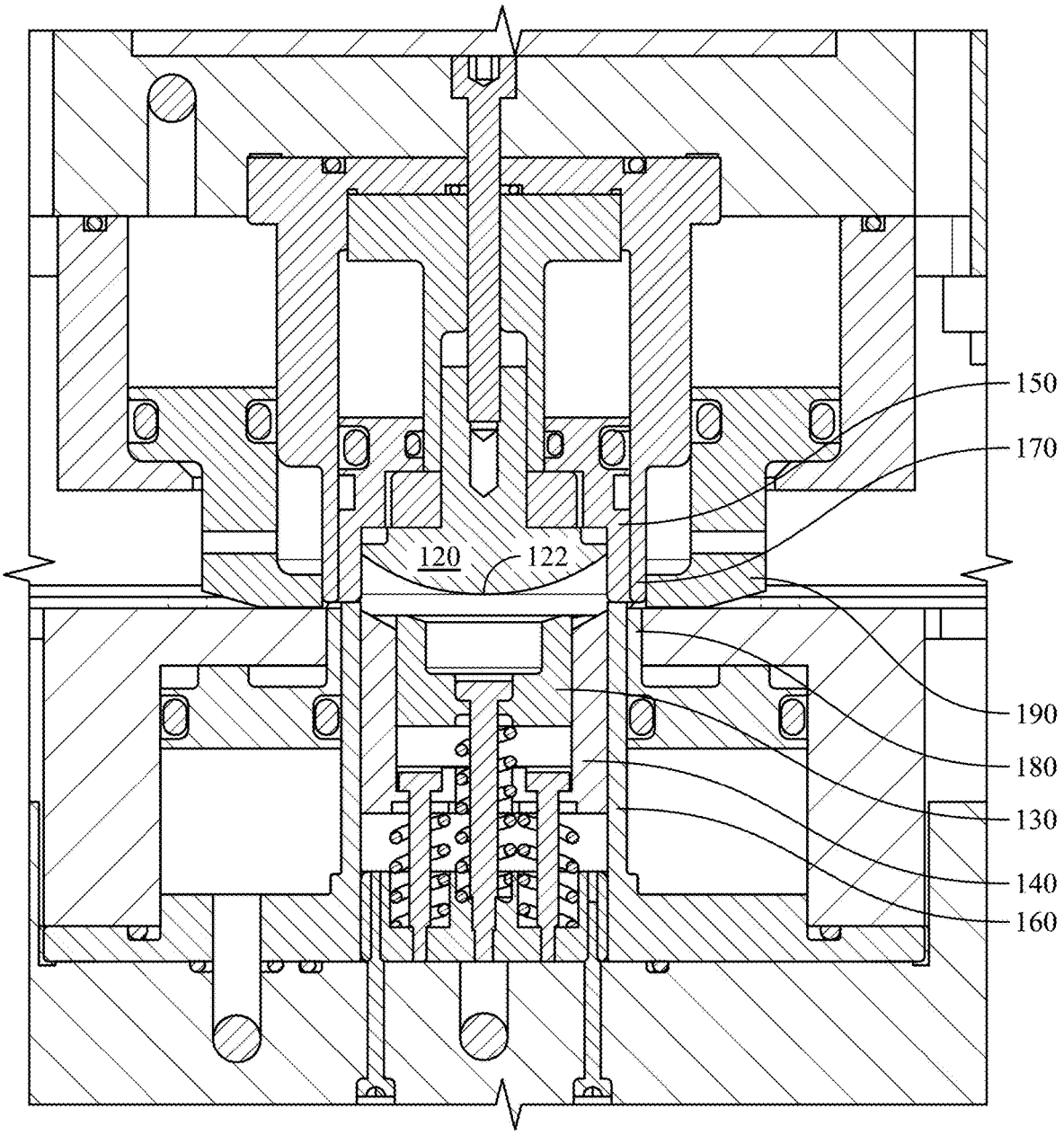
FIG. 21 is a view of the shell press tooling of FIG. 20 illustrating initial contact of the tooling with the metal sheet.

FIG. 20 illustrates tool pack 110 in the open position ready for insertion of a metal sheet. FIG. 21 illustrates the upper portion of tool pack 110 in its initial contact position in which the tools first contact the metal sheet before any deformation or blanking of the sheet. Stripper hold down 200 contacts the sheet to act against cut edge 190 to prevent movement of the sheet. In this position, punch sleeve 170 moves down relative to the sheet to form the blank when the punch sleeve 170 and cut edge 190 are engaged together. Springs 136 and 146 of inner pressure sleeve 130 and outer pressure sleeve 140 are in their rest or pre-loaded positions.

Figure 22:
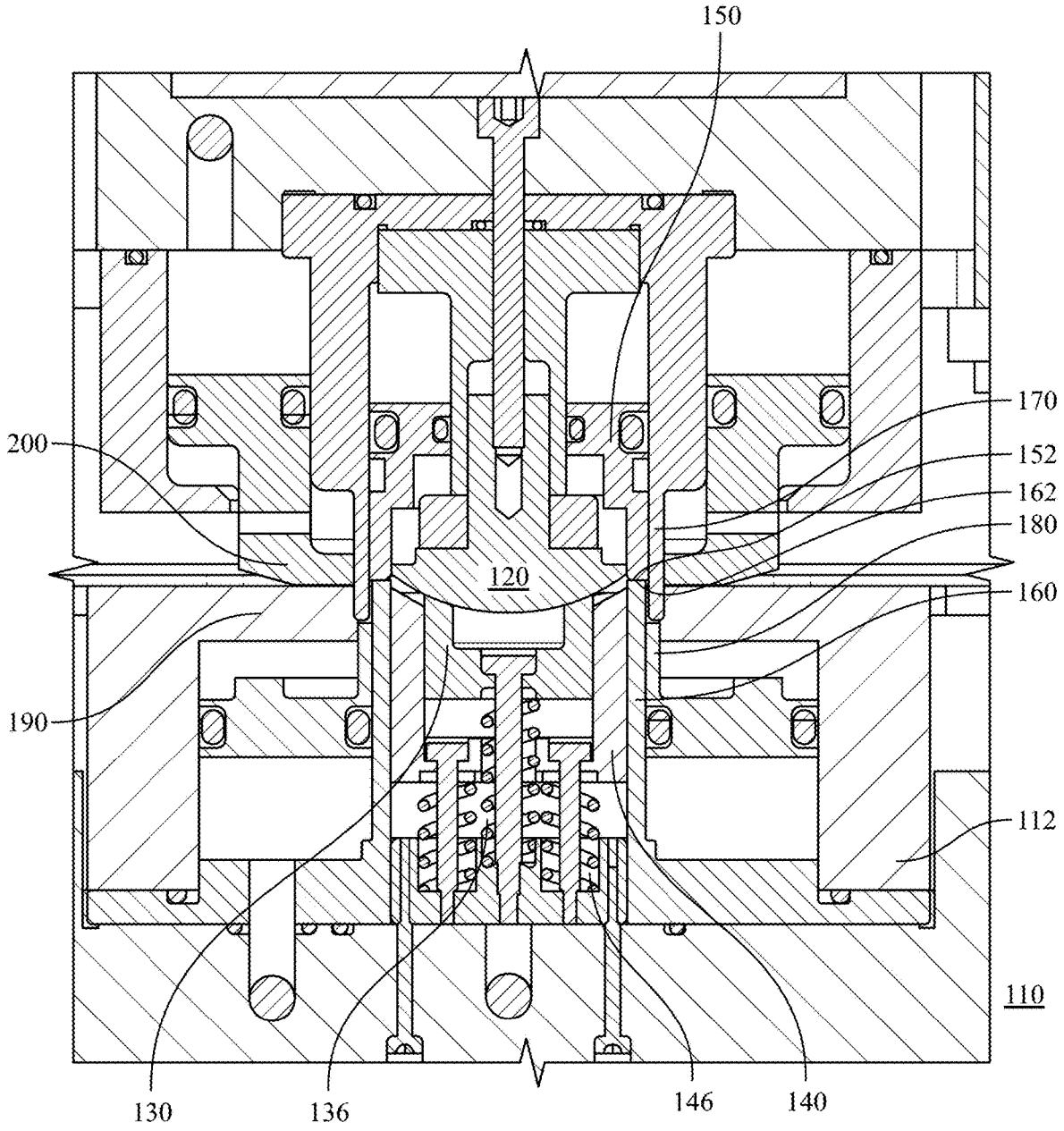
FIG. 22 is a view of the shell press tooling of FIG. 20 illustrating partial deformation of the metal blank.

FIG. 22 shows that punch sleeve 170 has moved downward relative to cut edge 190 to form the circular blank. Opposing contact surfaces 152 and 162 of sleeves 150 and 160 engage the blank with a force that is chosen to enable the blank to be drawn (as distinguished to thinning the metal sheet by stretching) while diminishing wrinkling. Punch 120 moves downwardly relative to a base 112 of the shell press such that an underside of the blank contacts the contact surface 134 of inner pressure sleeve 134, compressing the spring 136 at the base of inner pressure sleeve 130. Opposing surfaces 134 and 124*a* apply a force to the blank for reducing wrinkling. At the stage shown in FIG. 22, an uppermost tip of outer pressure sleeve 140 may contact the blank or may be spaced apart from the blank, but the full surface 144 has (preferably) not yet engaged the blank and thus outer pressure sleeve spring 146 is not compressed from its rest position.

Figure 23:
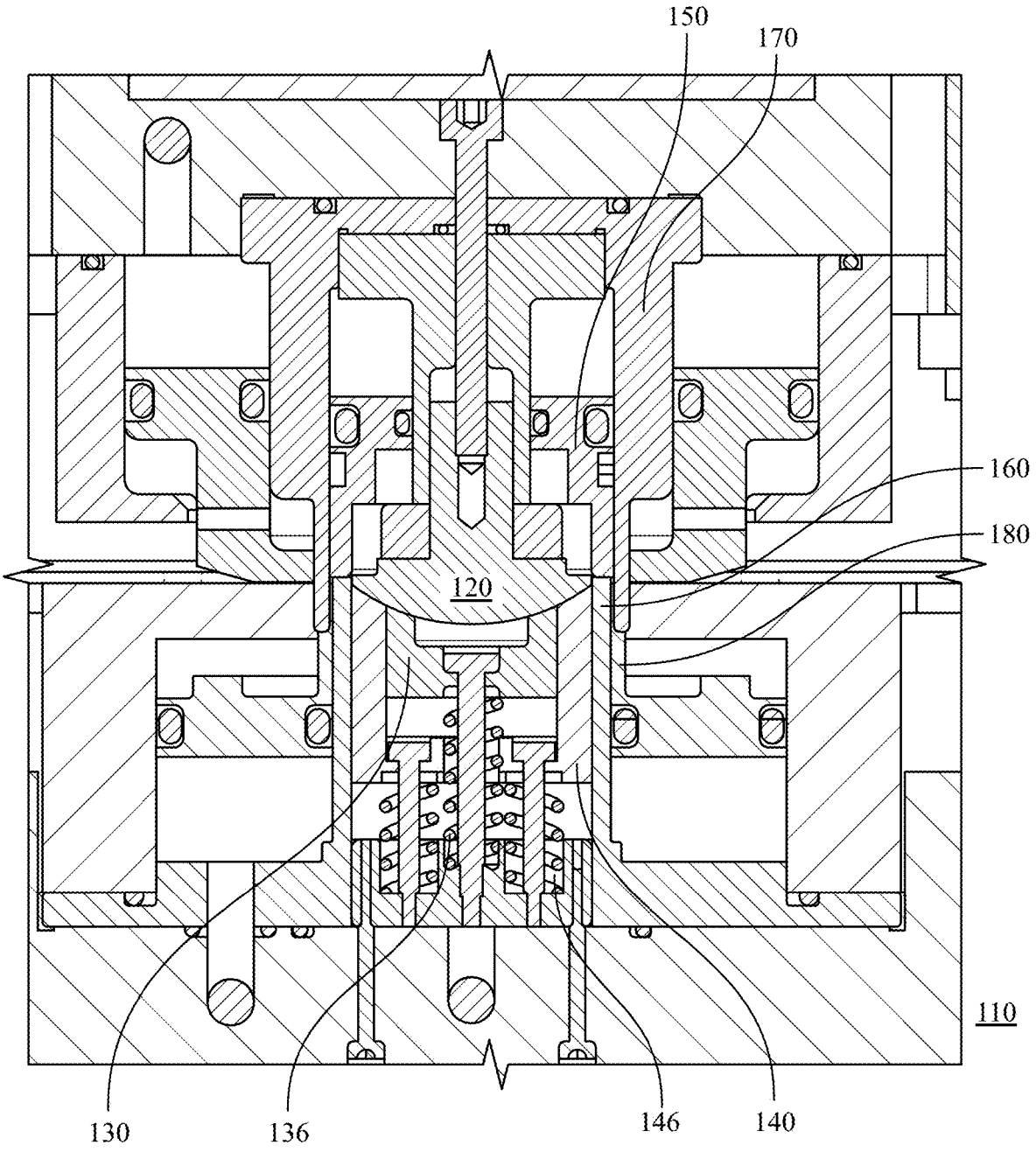
FIG. 23 is a view of the shell press tooling of FIG. 20 illustrating further deformation of the metal blank.

FIG. 23 shows punch 120 at the bottom of its stroke such that both pressure sleeve contact surfaces 134 and 144 are in contact with the blank to apply their corresponding spring forces, inner pressure sleeve spring 136 is further compressed relative to the view shown in FIG. 22, outer pressure sleeve spring 146 is compressed, and force has been applied to contact surfaces 152 and 162 to form a periphery of the blank into a shell 8, as best shown in FIG. 24. The perimeter of shell 8 has curved structure 11 as formed by contact of the upper pressure sleeve 150 and die center ring 160.

Inner pressure sleeve 130 and outer pressure sleeve 140, with an opening at the center, provide a compressive force that help to diminish wrinkling during drawing the end. The spring forces of 136 and 146 may be chosen for this purpose, but preferably are not large enough to "coin" the blank, which occurs in the prior art dome formation described in the background section. Inner pressure sleeve 130 is configured to move up and down independently from outer pressure sleeve 140.

Figure 26:
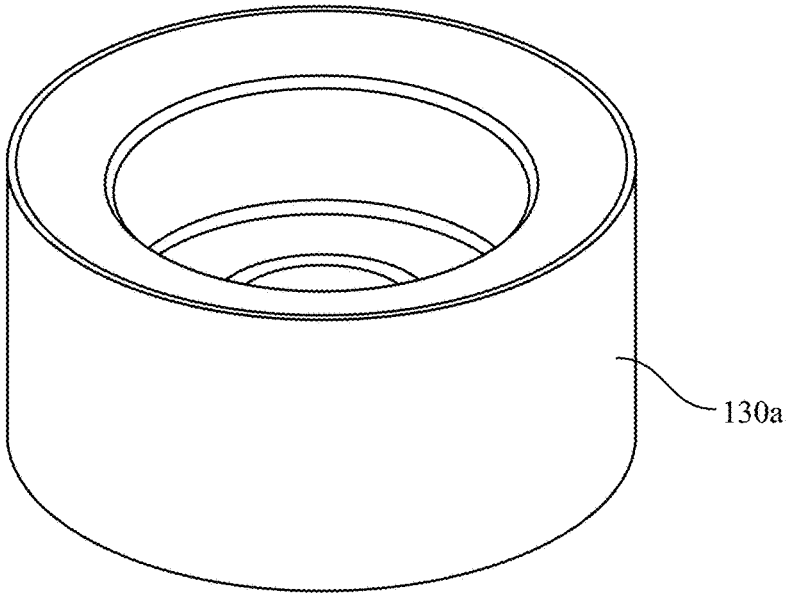
FIG. 26 is an enlarged view of a pressure sleeve component of the shell press tooling assembly of FIG. 25.
Figure 25:
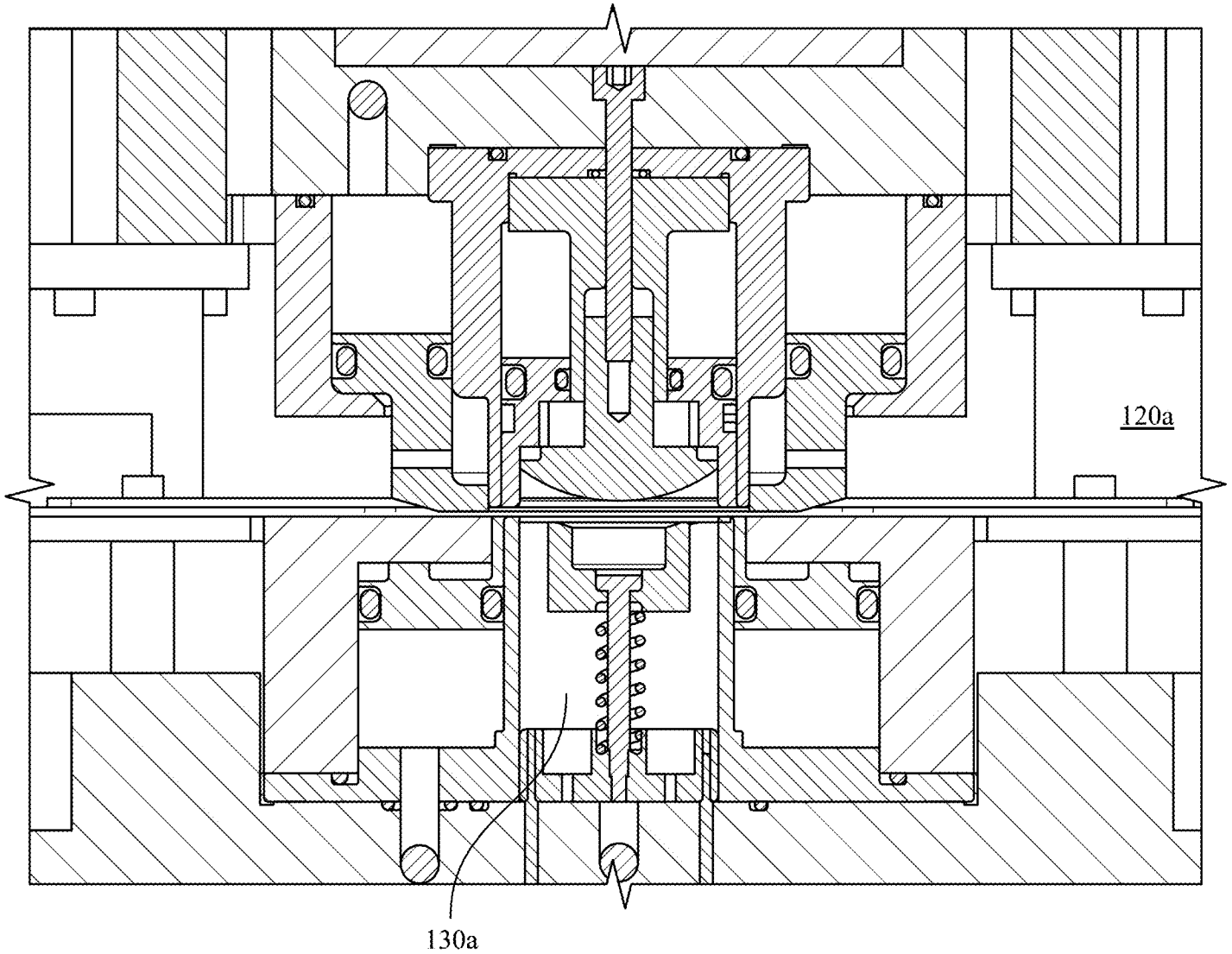
FIG. 25 is a side and partial cross sectional view of a second embodiment of the shell press tooling assembly illustrating initial contact of the tooling with the metal sheet.
Figure 27:
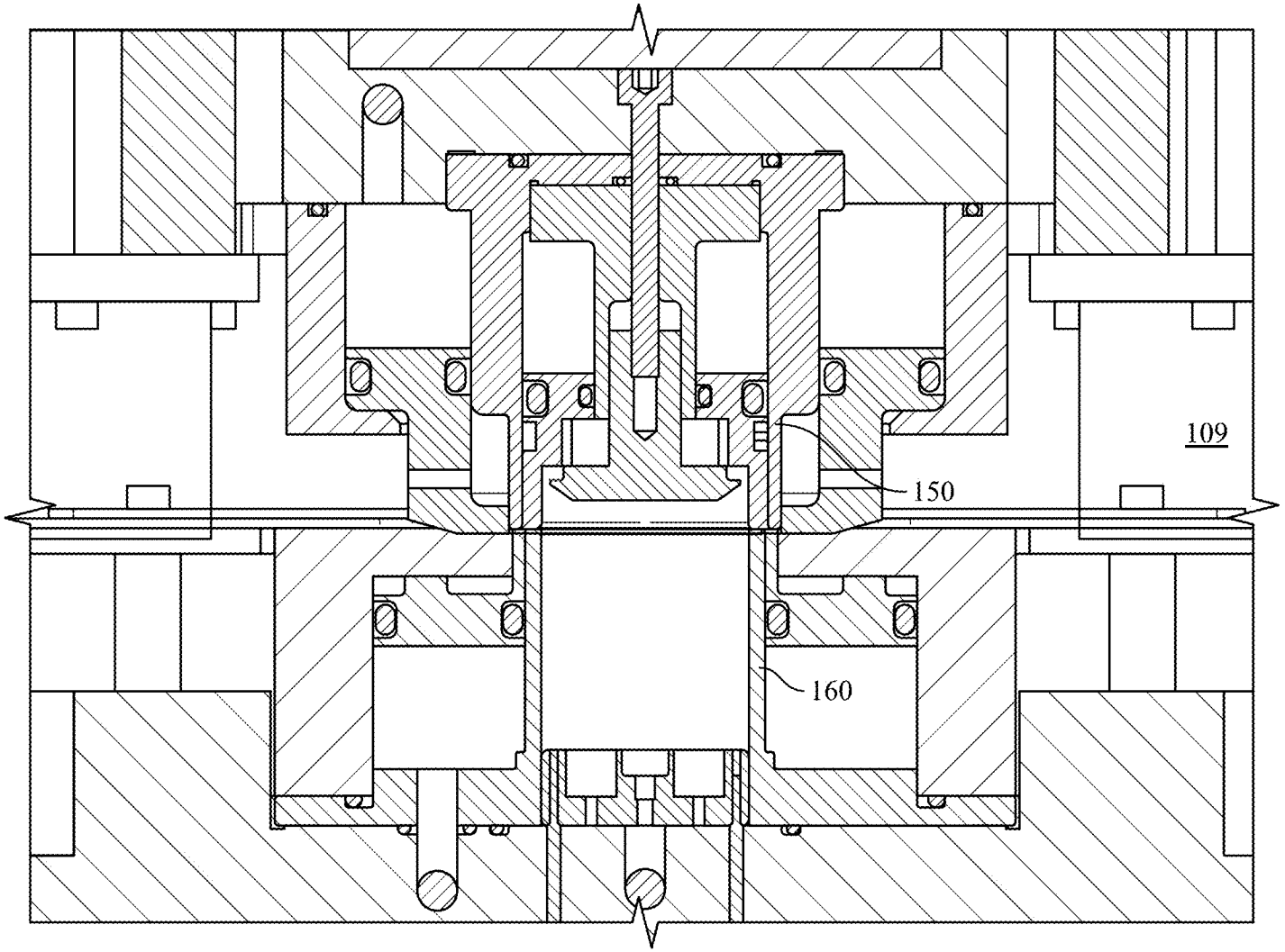
FIG. 27 is a side and partial cross sectional view of an optional process for forming a preform in the metal sheet or blank before the shell forming process, illustrating initial contact of the tooling with the metal sheet.
Figure 28:
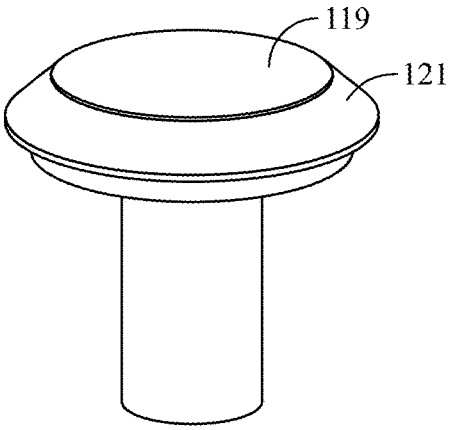
FIG. 28 is an enlarged view of a component of the preform tooling assembly of FIG. 27.

Alternatively, the inventors surmise that a single pressure sleeve 130*a* shown in FIGS. 25 and 26 may be employed in some circumstances (rather than a two-part pressure sleeve described above) to diminish wrinkling. Further, the inventors surmise that in some circumstances a preform may be formed before the sheet or blank is fed into the shell press 110. FIGS. 27 and 28 illustrate a preform press 109 that includes a center preform punch 119 having a contact surface 121 at its periphery. When punch 119 moves down, the sheet or blank is deformed by partial drawing. Optionally, sleeves 150 and 160, as described above, may partially or fully form the end shell 11. The scoring operation for form score 18 may be formed at any point in the process for forming end 10'.

Figure 12:
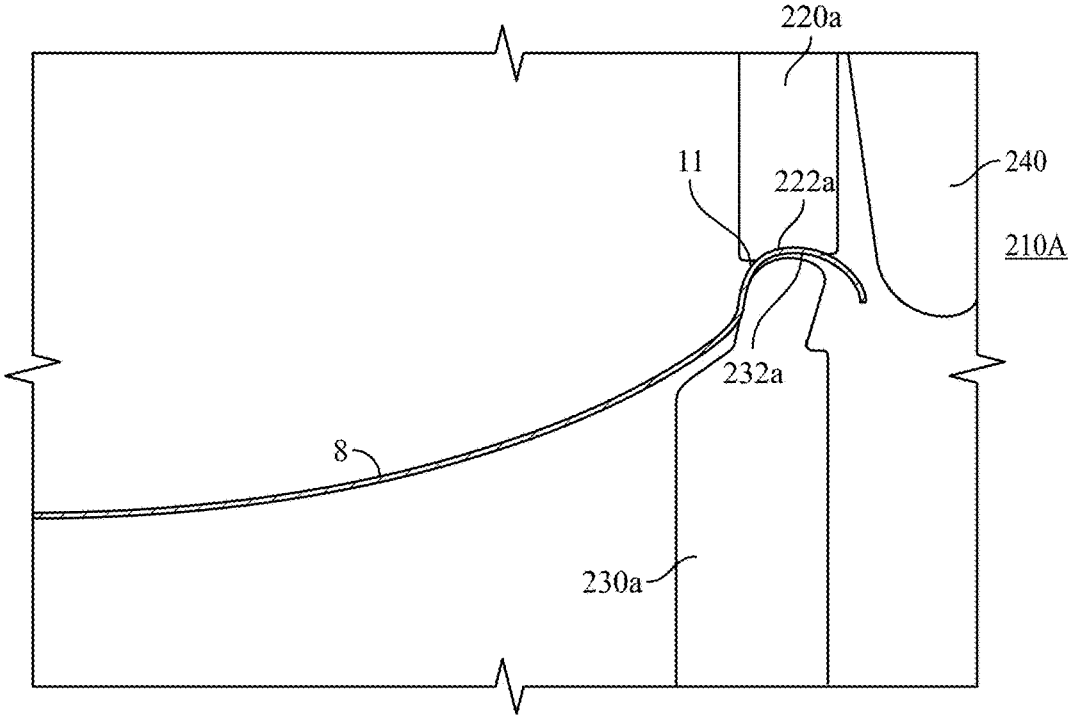
FIG. 12 is a cross sectional view of an end shell clamped into a first curling process tooling, the end shell not yet being deformed in the curling process.
Figure 13:
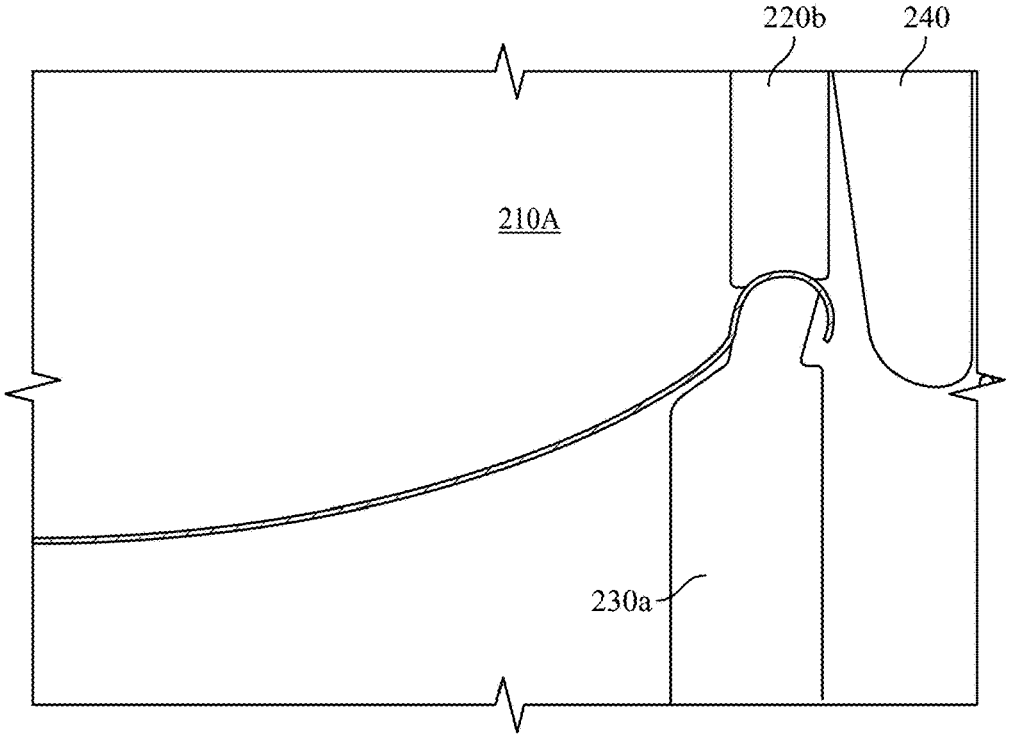
FIG. 13 is a view of the end shell shown in FIG. 12 after it has been deformed into a pre-curl in the first curling process and ready for removal from the first set of tooling.

FIGS. 12, 13, and 14 illustrate a two stage curling process to curl the shell 8 of the shell press 100 to form shell 9, which is the finished shell that is then produced into end 10 by a conversion press.

Curling tooling 210A of the first curling process includes an upper pressure ring 220*a*, an opposing lower pressure ring 230*a*, and an upper curling tool 240. The shell 8, which is the product of the shell press 100, is illustrated in FIG. 12 such that the shell curl geometry 11 is held between the corresponding concave contact surface 222*a* of upper pressure ring 220*a* and convex contact surface 232*a* of lower pressure ring 230*a*. Upper curling tool 240 is in its ready position where it is configured to move downwardly to contact shell curl geometry 11 to create a pre-curl 11'. FIG. 13 illustrates the end of the first stage process before the shell has been removed from first tooling 210A and inserted into the second stage tooling.

FIG. 14 illustrates a second set of the two curling processes. In this regard, tooling 210B includes an upper pressure ring 220*b*, an opposing lower pressure ring 230*b*, and a curling tool 250. FIG. 13 illustrates the end 9, which is the product of the first curling stage 210A, including having a pre-curl or intermediate curl 11'. Curling tool 250 is in its ready position where it is configured to move upwardly to contact the intermediate curl 11', which is held by is held between the corresponding concave contact surface 222*b* of upper pressure ring 220*b* and convex contact surface 232*b* of lower pressure ring 230*b*. FIG. 14 illustrates tooling 210B after curling tool 250 has retracted to its ready position after engaging and forming curl 12. The shell 9 as output from tooling 210*b* is ready for the conversion press.

Ends formed in the configurations described herein can have the advantages (compared with ends formed with a flat center panel and/or countersink groove) of a reduced blank size and/or reduced thickness, which could enable a reduction in the metal usage of the end. In addition to the information above, the inventors predict that a 42 mm shell may use only about half the material weight (approximately 1.05 g) as a corresponding lightweight end, such as that marketed by Crown Cork & Seal as a 202 size 202 Superend® can end. Further, because the end 10 shown in the figures does not have a groove near the wall, the pour opening can be configured closer to the seam, which in some circumstances may improve the drinking and/or pouring process. The end also is well suited to normal pressure ratings, such as the ability to withstand 90 psi internal pressure.

As an example, a seamed embodiment of package 5 may include end 10' as described herein seamed together with DWI beverage can 50 of a 66 mm size or 211 size can body. The package also encompasses 58 mm size or 204 size and 53 mm size or 202 size can body and other sizes referred to herein. The present invention is not limited by can body diameter unless expressly set out in the claim, as the disclosure of can body sizes is to support specific claims to standard can body sizes, including 211 cans as well as those sometimes referred to as sleek or slim cans.

Figure 29:
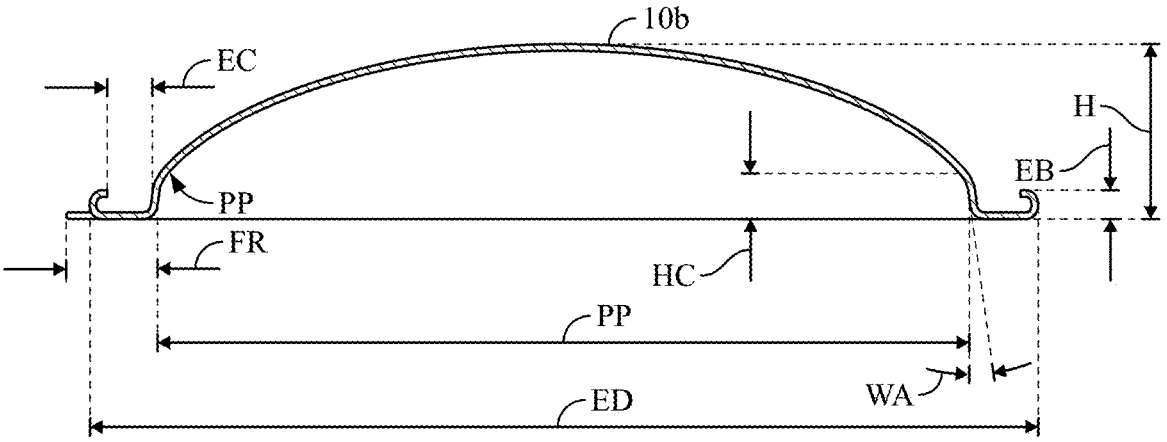
FIG. 29 is schematic view of a can end suitable for use with aerosol can packages.

FIG. 29 is a view of an end 10*b* for the base of a can, such as an aerosol can. The material conventionally used for an aluminium aerosol base is H19 that is 0.34 mm (0.0135 inches) thick. End 10*b* can be formed according to the methods described herein. End 10*b* may be formed using the tooling and method disclosed herein.

TABLE 2

Aerosol End Dimensions
Bottom End Specification

| Entity Code | Entity Description | Value |
|---|---|---|
| | Component Material Specification | .0135 H19 Aluminum |
| HC (DC) | Countersink Depth | .130 inch |
| ED | Curl External Diameter | 2.385 inch |
| EC | Curl Opening | .130 inch |
| EB | Curl Height | .082 inch |
| FR (RF) | Re-Straightened Curl | .260 inch |
| pp | Punch Plug Diameter | 1.968 inch |
| rpp | Punch Plug Radius | .037 inch |
| WA | Chuck Wall Angle | 4°-4.5° ref. |
| H | Component Height | .429 inch |

The present invention is not limited to the particular embodiments or combination of features disclosed herein. For one example, without intending to be limiting, the dome profiles may be chosen according to particular desired parameters. The design principles may also be used for containers that do not require 90 psi ratings, such as low carbonation soft drinks or food containers, such that the end material may be thinner or smaller diameter than described above.

The invention claimed is:

1. An unseamed can end capable of withstanding 90 psi internal pressure after seaming onto a can body, the can end being formed of an aluminum alloy, the can end comprising:

a curl structure adapted for being seamed together with a flange of a can body;

a chuck wall extending radially inwardly from the curl structure, the chuck wall is adapted for contact with a chuck during the seaming process;

an inwardly domed panel radially inwardly from the chuck wall, wherein a slope of every tangent of every curve defined by the can end at every point of the chuck wall and the domed panel is non-zero except at a center of the panel;

a score formed on the panel; and a tab attached to the panel and adapted for rupturing the score in response to actuation of the tab by a user to form a pour opening.

2. The can end of claim 1 wherein the panel extends from a lower end of the chuck wall into the panel with no countersink bead therebetween.

3. The can end of claim 2 wherein a diameter of the can end is less than 10 times a height of the dome at a center of the end.

4. The can end of claim 2 wherein a diameter of the can end is between 4 and 8 times a height of the dome at a center of the end.

5. The can end of claim 4 wherein the can end is formed of an aluminum alloy that is less than 0.20 inches thick.

6. The can end of claim 4 wherein the can end is formed of an aluminum alloy that is less than 0.18 inches thick.

7. The can end of claim 4 wherein the can end is formed of an aluminum alloy that is less than 0.16 inches thick.

8. The can end of claim 2 wherein the can end has a stacking height S of between 1.7 and 3.0 mm.

9. The can end of claim 8 wherein the can end has a stacking height S of at least 1.8 mm.

10. The can end of claim 2 wherein the curl structure has a curl width of less than 3.5 mm measured radially and horizontally between the outboard most point of the curl structure and a point on the curl at which a seaming panel of the curl structure yields to a relatively straight portion of a chuck wall of the end.

11. The can end of claim 2 wherein the curl structure has a curl width of less than 3.0 mm measured radially and horizontally between the outboard most point of the curl structure and the point on the curl at which a seaming panel of the curl structure yields to a relatively straight portion of a chuck wall of the end.

12. The can end of claim 2 wherein the can end is any one of a beverage can end and a food can end.

13. The can end of claim 2 wherein the panel in cross section is formed by multiple radii that decrease with radial position from the panel center.

14. The can end of claim 2 wherein the panel radius R1 inboard and proximate the chuck wall is between 0.5 mm and 2 mm, the panel radius R4 at the center of the panel is between 35 mm and 55 mm, and the can end diameter is between 38 and 52 mm.

15. The can end of claim 2 wherein the panel radius R1 inboard and proximate the chuck wall is between 0.5 mm and 4 mm, the panel radius R2 inboard and proximate radius R1 is between 7 mm and 20 mm, the panel radius R3 inboard and proximate to radius R2 is between 28 mm and 41 mm, the panel radius R4 at the center of the panel is between 35 mm and 55 mm, the can end diameter is between 38 and 52 mm.

16. The can end of claim 15 wherein the panel radius R1 is between 0.7 mm and 2.0 mm, the panel radius R2 is between 10 mm to 16 mm, the do panel me radius R3 is between 31 mm to 37 mm, and the panel radius R4 is between 40 mm and 50 mm.

17. The can end of claim 15 wherein the panel radius R1 is approximately 1.0 mm, the panel radius R2 is approximately 13 mm, the panel radius R3 is approximately 34 mm, and the panel radius R4 is approximately 44 mm.

18. The can end of claim 2 wherein the panel has a diameter of between 38 mm and 52 mm.

19. The can end of claim 2 wherein the pour opening defined by the score has a straight line dimension measured radially by a line that is inclined at an angle defined by opposite points of the pour opening of between 14 mm and 19 mm.

20. The can end of claim 2 wherein the pour opening defined by the score has a straight line dimension measured radially by a line that is inclined at an angle defined by opposite points of the pour opening of between 15 mm and 17 mm.

21. The can end of claim 2 wherein a horizontal clearance defined between an innermost part of the chuck wall and an outboard-most portion of the score is between 0.6 mm and 3.0 mm.

22. The can end of claim 2 wherein a horizontal clearance defined between an innermost part of the chuck wall and an outboard-most portion of the score is between 1.0 mm and 2.0 mm.

23. The can end of claim 2 wherein a horizontal clearance defined between an innermost part of the chuck wall and an outboard-most portion of the score is between 1.0 mm and 1.4 mm.

24. The can end of claim 2 wherein the tab is concavely curved.

25. The can end of claim 24 wherein a finger clearance F defined between an innermost part of the chuck wall and distal-most portion of the tab heel measured on an incline is between 6 mm and 15 mm.

26. The can end of claim 24 wherein a finger clearance F defined between an innermost part of the chuck wall and distal-most portion of the tab heel measured on an incline is between 7 mm and 10 mm.

27. The can end of claim 2 wherein the unseamed end has a panel depth of between 5 mm and 16 mm.

28. The can end of claim 2 wherein the unseamed end has a panel depth of between 6 mm and 10 mm.

29. The can end of claim 2 wherein the unseamed end has a panel depth of approximately 8 mm.

30. The can end of claim 2 wherein the score extends around a perimeter of the panel proximate the wall, such that the end is a full aperture end.

31. The can end of claim 30 wherein the end is approximately a 30 mm size.

32. An unseamed can end and can body combination comprising:

a drawn and ironed can body including a base, a sidewall, and a flange; and an unseamed can end including:

a curl structure engaged with the flange;

a chuck wall extending radially inwardly from the curl structure, the chuck wall is adapted for contact with a chuck during the seaming process;

an inwardly domed panel radially inwardly from the chuck wall, wherein a slope of every tangent of every curve defined by the can end at every point of the chuck wall and the domed panel is non-zero except at a center of the panel;

a score formed on the panel; and a tab attached to the panel and adapted for rupturing the score in response to actuation of the tab by a user to form a pour opening.

33. The combination of claim 32 wherein radial clearance between the flange proximate a neck of the can and the curl is at least 0.5 mm.

34. The combination of claim 33 wherein the clearance is measured at a chuck wall of the end.

35. The combination of claim 32 wherein the thickness of the can end measured at the curl structure is at least than 10% less than the thickness of the flange.

36. The combination of claim 32 wherein the thickness of the can end measured at the curl structure is at least than 20% less than the thickness of the flange.

37. The combination of claim 32 wherein the flange width is less than 1.8 mm, measured radially from an inboard side of a vertical portion of a neck of the can to an outermost lip of the flange.

38. The combination of claim 37 wherein the flange width is less than 1.6 mm.

39. The combination of claim 37 wherein the flange width is less than 1.5 mm.

40. The combination of claim 32 wherein the height of the curl is greater than the width of the flange by at least 0.5 mm.

41. The combination of claim 32 wherein the height of the curl is greater than the width of the flange by at least 0.2 mm.

42. The combination of claim 32 wherein the height of the curl is greater than the width of the flange.

43. The combination of claim 32 wherein a curl clearance dimension measured horizontally between an outermost tip of the flange and an innermost tip of the curl is between 0.4 to 1.2 mm.

44. The combination of claim 32 wherein the panel extends from a lower end of the chuck wall into the panel with no countersink bead therebetween.

45. The combination of claim 32 wherein a diameter of the can end is less than between 4 and 8 times a height of the panel at a center of the end.

46. The combination of claim 32 wherein the end has a stacking height S of at least 1.8 mm.

47. The combination of claim 32 wherein the combination is any one of a beverage can package and a food can package.

48. The combination of claim 32 wherein the panel in cross section is formed by multiple radii that decrease with radial position from the panel center.

49. The combination of claim 32 wherein the can end has a diameter of between 38 mm and 52 mm.

50. The combination of claim 32 wherein the can end is formed of a 5000 series aluminum alloy and the can body is formed of a 3000 series aluminum alloy.

51. A container for holding a comestible product, the container comprising:

a drawn and ironed can body including a base, a sidewall, and a neck;

a can end including:

a chuck wall extending radially inwardly from a curl structure, the chuck wall is adapted for contact with a chuck during the seaming process;

an inwardly domed panel radially inwardly from the chuck wall, wherein the domed panel in cross section is formed by multiple radii that decrease with radial position from the panel center to a curved portion inboard and proximate the chuck wall;

a score formed on the panel; and a tab attached to the panel and adapted for rupturing the score in response to actuation of the tab by a user to form a pour opening; and a terminal portion of the can body and a terminal portion of the can end being joined together by a double seam having a seam height that is less than approximately 2.2 mm.

52. The container of claim 51 wherein a thickness of a terminal portion of the end is no more than a thickness of the terminal portion of the can body.

53. The container of claim 51 wherein a seam thickness is no more than 1.1 mm.

54. The container of claim 51 wherein a seam thickness is no more than 0.96 mm.

55. The container of claim 51 wherein a seam thickness is between 0.85 and 0.93 mm.

56. The container of claim 51 wherein a seam length is no more than 2.2 mm.

57. The container of claim 51 wherein a seam length is approximately 2.0 mm.

58. The container of claim 51 wherein a seam radius is no more than 0.6 mm.

59. The container of claim 51 wherein a seam radius is no more than 0.55 mm.

60. The container of claim 51 wherein the double seaming includes: (i) a cover hook, an end hook, a seaming panel, and a chuck wall of the terminal portion of the can body and (ii) a body wall and a body hook of the can end; an overlap between the body hook and the cover hook is between 0.65 and 1.2 mm.

61. The container of claim 60 wherein the overlap between the body hook and the cover hook is approximately 0.9 mm.

62. The container of claim 51 wherein the panel extends from a lower end of the chuck wall into the panel with no countersink bead therebetween.

63. The container of claim 51 wherein a diameter of the can end is less than between 4 and 8 times a height of the panel at a center of the can end.

64. The container of claim 51 wherein the can end is any one of a beverage can end and a food can end.

65. The container of claim 51 wherein the can end has a diameter of between 38 mm and 52 mm.

66. The container of claim 51 wherein the can end is formed of a 5000 series aluminum alloy and the can body is formed of a 3000 series aluminum alloy.

67. The container of claim 51 wherein a vertical height between liquid contents of the container and the underside of the can end at its center is between 13 mm and 18 mm.

68. The container of claim 51 wherein a vertical height between liquid contents of the container and a top of the can seam is between 10 and 30 mm.

69. A container for holding a comestible product, the container comprising:

a can body;

a can end including:

a chuck wall extending radially inwardly from a curl structure, the chuck wall is adapted for contact with a chuck during the seaming process;

an inwardly domed panel radially inwardly from the chuck wall, wherein the domed panel in cross section is formed by multiple radii that decrease with radial position from the panel center to a curved portion inboard and proximate the chuck wall;

a terminal portion of the can body and a terminal portion of the end being joined together by a double seam having a seam height that is less than approximately 2.2 mm.

70. The container of claim 69 wherein the can end is formed of an aluminum alloy that is less than 0.20 inches thick.

71. The container of claim 69 wherein the can end is formed of an aluminum alloy that is less than 0.18 inches thick.

72. The container of claim 69 wherein the can end is formed of an aluminum alloy that is less than 0.16 inches thick.

* * * * *